US007832470B2

(12) United States Patent
Anthony

(10) Patent No.: US 7,832,470 B2
(45) Date of Patent: Nov. 16, 2010

(54) MOUSE HOLE SUPPORT UNIT WITH ROTATABLE OR STATIONARY OPERATION

(75) Inventor: Paul Anthony, Bakersfield, CA (US)

(73) Assignee: Xtech Industries, Inc., Bakersfield, CA (US)

( * ) Notice: Subject to any disclaimer, the term of this patent is extended or adjusted under 35 U.S.C. 154(b) by 107 days.

(21) Appl. No.: 12/072,601

(22) Filed: Feb. 26, 2008

(65) Prior Publication Data

US 2008/0202813 A1 Aug. 28, 2008

Related U.S. Application Data

(60) Provisional application No. 60/903,699, filed on Feb. 27, 2007, provisional application No. 60/903,721, filed on Feb. 27, 2007.

(51) Int. Cl.
*E21B 19/10* (2006.01)
*E21B 23/00* (2006.01)

(52) U.S. Cl. ..... 166/77.53; 166/382; 175/423

(58) Field of Classification Search ..... 175/423; 166/77.53, 77.51, 78.1, 382, 88.2; 188/67
See application file for complete search history.

(56) References Cited

U.S. PATENT DOCUMENTS 2,662,737 A * 12/1953 Edelberg ..... 173/164
3,629,927 A 12/1971 Palmer et al.
3,689,060 A 9/1972 Hensley, Jr.
3,760,658 A 9/1973 Guier
4,099,429 A * 7/1978 Hauk ..... 81/57.17
4,221,269 A 9/1980 Hudson
4,715,456 A * 12/1987 Poe et al. ..... 175/423
4,756,538 A 7/1988 Yuehui et al.
4,765,401 A 8/1988 Boyadjieff
4,791,997 A 12/1988 Krasnov
4,843,945 A 7/1989 Dinsdale
4,854,400 A 8/1989 Simpson
5,255,751 A 10/1993 Stogner
5,351,767 A 10/1994 Stogner et al.
6,138,776 A 10/2000 Hart et al.

(Continued)

OTHER PUBLICATIONS

Rigs & Drillers, RigData A buyser's and Seller's Guide to U.S. Land and Offshore Drilling Rigs, vol. 3, 2006.

*Primary Examiner*—David J Bagnell
*Assistant Examiner*—Catherine Loikith
(74) *Attorney, Agent, or Firm*—Mark D. Miller

(57) ABSTRACT

The present invention allows for the connection of multiple sections of drill pipe in a mouse hole by securing a given section of pipe in the hole and delivering a rotational force to secure that pipe section to another section of drill pipe placed above it over the mouse hole. In some embodiments, the rotational force may be provided by the support unit of the present invention. In alternative embodiments, the rotational force may be provided by an outside source such as an iron roughneck, with the support unit of the present invention holding the drill pipe section in a stationary position as such force is delivered. The unit then allows the connected pipe sections to be lowered and secured so the process can be repeated to connect multiple sections of drill pipe together in the mouse hole. The multiple sections of drill pipe may then be retrieved as a unit, and attached to the pipe string already being used to drill the well.

38 Claims, 21 Drawing Sheets

U.S. PATENT DOCUMENTS 6,212,976 B1 4/2001 Stogner
6,394,201 B1 * 5/2002 Feigel et al. ..... 175/423
6,412,576 B1 7/2002 Meiners
7,117,938 B2 10/2006 Hamilton et al.
7,293,618 B2 * 11/2007 Belik ..... 175/423
7,419,008 B2 * 9/2008 Campisi et al. ..... 166/379
7,527,093 B2 * 5/2009 Mosing et al. ..... 166/75.14
2003/0221871 A1 12/2003 Hamilton et al.

* cited by examiner

DETAIL A
SCALE 1 : 2

MOUSE HOLE SUPPORT UNIT WITH ROTATABLE OR STATIONARY OPERATION

This application claims the benefit of U.S. Provisional Application No. 60/903,699 filed on Feb. 27, 2007, and U.S. Provisional Application No. 60/903,721 filed on Feb. 27, 2007, both of which are incorporated herein by this reference in their entirety.

BACKGROUND OF THE INVENTION

1. Field of the Invention

The present invention relates to methods and apparatus for use with a shallow bore hole under the floor of a drilling rig in which sections of drill pipe are temporarily placed before being connected to the drill assembly, and more particularly to methods and apparatus for supporting drill pipe sections in a house hole adjacent to a drilling rig.

2. Description of the Prior Art

Drilling rigs are designed to drill wells deep into the earth's surface in order to extract materials such as oil, gas, etc. In order to drill effectively a great distance, the drill pipe consists of sections or "joints" of drill pipe or tubing which are continuously attached together at the drill assembly to obtain a pipe having a desired length. Such sections of drill pipe are typically 30 feet in length. In order to attach a new section of drill tubing to the existing pipe being used for the drill, the new section of drill pipe must be in a generally vertical position for attachment. Because of the weight and size of drill pipe sections, each such section of drill pipe requires support in order to be placed in a vertical orientation. In order to prepare a section of drill pipe for attachment, a common solution has been to provide a shallow bore hole adjacent to the much deeper drilling hole in the rig, into which such pipe sections are inserted in a generally vertical orientation prior to installation onto the main shaft of piping. Such shallow holes are commonly referred to as "mouse holes."

A mouse hole is typically lined with wider piping and used as a convenient location to store the next section of drill pipe. A typical mouse-hole is usually just slightly shallower than a section of pipe. Thus, when a section of pipe is lowered into the mouse-hole, it can rest on the bottom and lean against the walls of the mouse-hole to stay in a generally vertical orientation, with the top portion of the pipe section extending above ground in order to be accessible for removal and attachment to the main drill pipe. Once the drill pipe section is placed in the mouse hole, its position is generally upright and stable, allowing the equipment used to insert pipe section to be allocated to other uses.

Generally pipe is unloaded from a truck or other delivery vehicle and placed on a pipe rack for storage. When a new section of pipe is needed, a crew brings pipe from the pipe rack using a cat line, air hoist or hydraulic winch up to the drilling floor and places it in the mouse-hole.

By placing the new drill pipe section in the mouse hole, it can be prepared for attachment to the main drill pipe while a prior section of pipe is being drilled. The prior section of pipe is drilled into the ground until it reaches a depth where it is ready for the new pipe section to be attached. While this drilling is taking place, the new pipe section is hoisted out of the mouse hole, and maneuvered near the main drill bore in a generally vertical orientation. When the prior pipe section is drilled in far enough, the vertically oriented new pipe section is attached to it, and drilling continues. Under this method, drilling must stop roughly every thirty feet (the length of a typical section of pipe) to allow for the time to add another drill pipe section.

In many cases, this process involves removing the kelley from the prior section chain of drill pipe, and moving the kelley into position over the new pipe section in the mouse-hole. The new pipe section is attached to the kelley, and raised out of the mouse-hole. The bottom of the new pipe section is attached to the end of the prior pipe section of the existing pipe chain. While drilling crews become very efficient in adding pipe sections, the process still takes considerable time, and when repeated multiple times for deep wells, this amount of non-drilling time is significant. Because of the time-consuming nature of adding drill pipe sections, it is desirable to provide methods and apparatus for more efficient and speedy attachment of drill pipe sections.

Existing mouse hole support units are generally designed to be permanently mounted into or below the floor of a drilling rig, above the mouse hole itself. They are not portable. For new installations, it is a simple matter to dig out the mouse hole itself and then install the support unit into the floor of the rig over the mouse hole as the floor and rig is constructed. However, installing such a support unit in an existing drill rig is expensive and cumbersome since it will generally involve partially demolishing or replacing the floor of the drill rig in order to provide proper support for the unit. It is therefore desirable to provide a portable mouse hole pipe support unit, and/or mouse hole pipe support units that may be installed above or on top of an existing floor of a drill rig.

Existing mouse hole support units also suffer from the drawback that they are provided in only one size, such that shims or slips are required in order for these support units to engage a given section of pipe. With these existing units, different shims or slips are required for engaging pipes having different diameters. Such mouse hole support units include a rotatable bowl surrounding an opening through which the pipe section is inserted. The circumference of the opening is designed to be larger than the largest pipe section to be used, and the circumference of the bowl is larger still. As a result, once a pipe section is inserted through the bowl and opening, it is necessary to insert a plurality of shims or slips between the pipe section and the bowl in order to hold the pipe section in place in the bowl before it can be rotated for attachment to the next pipe section.

A typical drill pipe section may have two different diameters: a larger diameter at the ends of the section, and a narrower diameter along the middle portion of the drill pipe. The larger diameter at the end of the drill pipe creates an annular shoulder which can be used to prevent it from moving. The shims or slips are typically inserted adjacent to this annular shoulder to hold the pipe section in place when attaching one section of pipe to another, as described in U.S. Pat. No. 5,351,767. Once this attachment is achieved, the plurality of shims or slips must then be removed from the bowl so that the pipe section(s) may be removed. The insertion and removal of the shims or slips must be repeated for each pipe section that is inserted into the bowl, a process which takes considerable time. Different sizes of slips may be required for pipe section of different diameters. In addition, the slips and the frictional surfaces thereon tend to wear out from being constantly inserted and removed. It is therefore desirable to provide methods and apparatus for securely engaging pipes of different diameters in a mouse hole without the need for separate support shims or slips.

SUMMARY OF THE INVENTION

The present invention provides improved methods and apparatus for supporting and engaging drill pipe in a mouse hole that allows for multiple drill pipe sections or joints to be attached together before being attached to an existing drill string. The present invention is designed to allow for engagement and disengagement of drill pipe sections of various diameters without the need for manually inserting or removing support shims or slips. These features allow for speedy set up and attachment of drill pipe sections during drilling operations. The support unit of the present invention is also portable, and may be retrofitted into an existing drill rig platform.

Embodiments of the present invention allow for the connection of multiple sections of drill pipe in a mouse hole by securing a given section of pipe in the hole and delivering a rotational force to secure that pipe section to another section of drill pipe placed above it over the mouse hole. In some embodiments, the rotational force may be provided by the support unit of the present invention. In alternative embodiments, the rotational force may be provided by an outside source such as an iron roughneck, with the support unit of the present invention holding the drill pipe section in a stationary position as such force is delivered. The unit then allows the connected pipe sections to be lowered and secured so the process can be repeated to connect multiple sections of drill pipe together in the mouse hole. The multiple sections of drill pipe may then be retrieved as a unit, and attached to the pipe string already being used to drill the well. This saves considerable time when extending the length of the main drill pipe string. Instead of attaching a single section of pipe to the main pipe string each time, the present invention allows for a pre-connected set of multiple pipe sections to be attached. Thus, for example, if the set in the mouse hole is made up of three attached pipe sections, the time for drilling the same depth may be speeded up by much as two thirds.

The mouse hole of the present invention is different from standard mouse hole designs. Typically the depth of a mouse hole is slightly shorter than that of one section of pipe. The mouse hole of the present invention is at least twice as deep as such a standard mouse hole, if not deeper, in order to allow enough depth for the insertion of multiple sections of pipe, and to not limit the number of pipe sections that can be connected with the device at one time. Accordingly, the mouse hole should be of a depth to accommodate at least two or more sections of drill pipe. In one embodiment, the mouse hole accommodates three sections of drill pipe. It is to be appreciated that this greater depth is desirable in order to accomplish the connection of multiple sections of pipe together before those sections are removed as a unit from the mouse hole for attachment to the main drill pipe chain.

The support units of the present invention are provided for installation over a mouse hole. A support unit may be mounted above or below the floor of the drill rig surrounding the mouse hole to prevent movement. Embodiments of the support unit include a frame which is positioned above the mouse hole, and an engagement/slip assembly. The engagement assembly is capable of securely engaging a pipe section so that it may be held in place by the support unit. A first pipe section is lowered into the mouse hole and engaged by the assembly, and a second pipe section is then placed adjacent to the first pipe section (end to end). The second pipe may then be rotated using an external source such as an iron roughneck or the like, in order to engage it with the first pipe being held by the support unit in the mouse hole. In some embodiments, the engagement/slip assembly is capable of rotational movement. In the embodiments having such a rotational assembly, this assembly acts to rotate the engagement/slip assembly, and hence rotate any pipe(s) held by that assembly to facilitate attachment to other sections of pipe.

A large cylindrical opening is provided through the center of the frame for receiving a section of pipe that will extend through the opening into the mouse hole. In several embodiments, a plurality of movable support slips are provided around the inside of this opening for engaging a section of pipe inserted into the opening. The slips are capable of generally radial movement toward or away from the center of the opening. The slips move inward in order to engage a pipe section, and outward to release a pipe section. Skid plates, teeth or other rough frictional surfaces may be provided on the inwardly facing surfaces of the slips where they touch the pipe section in order to more securely engage the pipe section and prevent slippage. In several embodiments, the slips may be arcuate members, which may form a sectioned generally cylindrical clamping system. The slips need not be arcuate, however, as any suitably shaped set of slips may be provided so long as firm releasable engagement of the pipe section may be achieved. Individual slips (or pairs or groups of slips) separate from each other when moved outward in order to increase the size of the central opening to receive (or release) a pipe section. These slips come together when moved inward to decrease the size of the central opening to engage a pipe section. This allows for engagement with pipe sections having a wide variety of different diameters. In alternative embodiments, removable extensions may be provided on the slips to provide for prolonged wear of the slips by allowing for replacement of the removable extensions. In other embodiments, removable extensions may be provided for engagement with particularly narrow drill pipe sections. In such embodiments, frictional surfaces may be provided on the interior surfaces of the extensions where they come into contact with the drill pipe section.

In several embodiments, the automated movement of the slips is controlled by lever assemblies or linkages which establish the radial paths along which the slip assemblies extend and retract in relation to the center of the mouse hole. In these embodiments, the extension and retraction (inward and outward movement) of the slips is imparted by the lever assemblies. In some embodiments, a first arm is provided that extends across and is pivotally attached to the top of a generally cylindrical wall that defines the large central opening of the support frame. One end of the first arm is pivotally attached to one or more of the slips, and the opposite end is pivotally attached directly or indirectly to a motion imparting member. Thus, as the opposite end of the first arm is pulled down, the first arm acts as a lever across the generally cylindrical wall, such that the other end of the first arm (attached to the slip(s)) is raised, thereby raising the slip(s) upward and outward from the center opening. This opens the central opening for receiving (or releasing) a pipe section. The downward motion of the opposite end of the first arm is accomplished by the motion imparting member pulling downward. The farther down this member pulls the first arm, the higher and farther the slips are raised upward and outward from the center of the opening. Force may be imparted to the movable members from any appropriate source such as electrical, hydraulic, pneumatic, or mechanical provided by motors, pistons, engines or the like. In some embodiments, a second arm is pivotally connected to the opposite end of the first arm forming an elbow. In these embodiments, the opposite end of the second arm is pivotally attached to a motion imparting member that is capable of moving up and down, thereby transferring this motion through the second arm to the first arm.

It is to be appreciated that reversing this motion will cause the slips to move downward and inward toward the center of the opening. In particular, as each movable member moves up, it raises the opposite (or elbow) end of each first arm. This causes the other end of each first arm to travel downward and inward towards the center of the opening, bringing the slip(s) with it. This motion may be continued until the slips engage a pipe section in the opening, or until the slips are fully extended (preferably, but not necessarily flush with the upper surface of the frame) if no pipe is present. The movable member(s) impart sufficient force to the first arm (through the second arm, if used) to the slips to hold not only the weight of the pipe section engaged by the slips, but also the weight of other pipe sections attached thereto.

In some embodiments, the upward and downward motion is imparted through a peripheral (sometimes annular) support structure surrounding a generally cylindrical support wall, to which each of the lever assemblies is pivotally connected, either directly or indirectly. The peripheral support structure rotates with the cylindrical support wall, lever assemblies and slips in order to allow the slips to be rotated as part of the pipe coupling process. In other embodiments, these structures do not rotate. As the peripheral support structure moves downward, it causes the slips to move upward and outward. This motion is accomplished through the lever action of the arms attached to the slips which govern their movement, pulling them up and away from the center, so that the slips move both outward and upward at the same time. Then, when the peripheral support structure moves upward, the lever action of the linkages moves the slips down causing the slips to extend toward the center so that they move downward and inward at the same time. In some embodiments, the peripheral (sometime annular) support structure is rotatable with the generally cylindrical support wall. In other embodiments, the peripheral structure is not capable of such rotation.

When the slips are retracted in an outward and upward direction, a section of pipe may be lowered through the central opening and into the mouse hole. Once the pipe section has been vertically lowered to a desired position into the mouse hole, the peripheral support structure or other motion imparting device(s) are activated to compress the slips against the surface of the pipe. The force of the compression of the slips against the pipe section holds it in place. In addition, if the pipe is positioned such that its larger-diameter end portion is above the slips, the annular shoulder on the pipe also helps serve to prevent the pipe from falling though the opening and into the mouse-hole. It is to be appreciated that slips of different sizes and shapes may be attached to the linkages so long as the chosen configuration allows for capture and release of the particular drill pipe sections in use.

In several embodiments, once a section of drill pipe is engaged by the slips, the slips are capable of rotating the pipe section to secure it to either the kelley or to another section of pipe while still in the mouse hole. In these embodiments, rotational movement is imparted to the peripheral structure which rotates with the central cylinder, thereby rotating the slips and the secured drill pipe section around a central axis. In some embodiments, the peripheral structure is attached directly or indirectly (e.g., to the cylindrical wall) to, or includes a large gear structure having a set of cogs or teeth around its circumference. In these embodiments, a motor or other rotational member having a smaller corresponding and interengaging gear is provided adjacent to the large gear, such that operation of the motor or other rotational member imparts motion from the smaller gear to the larger one, thereby rotating the entire support system, including the peripheral support structure, generally cylindrical support wall, lever assemblies and slips.

In other embodiments, the peripheral support structure is not capable of rotational movement, but merely imparts the upward/downward movement necessary to extend and retract the slips. In some embodiments, the peripheral support structure is replaced by separate fixed-position lifting structures that are provided for each lever assembly or linkage. In these non-rotational embodiments, the rotational movement of the pipe section is imparted from an external source such as an iron roughneck or the like.

In those embodiments using a peripheral support structure, it is important that upward and downward motion be imparted to the support structure evenly. In several embodiments, this is accomplished by means of lifting structures that are positioned around the peripheral support structure. At least two lift points should be used, and the lift points should preferably be equally spaced from each other. This allows for uniform upward and downward movement of the peripheral support structure. If two lifts are used, they should be positioned at opposite locations around the periphery of the support structure (i.e., about 180° apart); if three lifts are used, they should be equally spaced from each other (i.e., about 120° apart); if four are used, the equal spacing should be about 90° apart; etc. The lifting structures may be electrical, hydraulic, pneumatic, or mechanical with the lifting and lowering force provided by motors, pistons, engines or the like.

In the rotating embodiments and in other embodiments, each lifting structure may be provided with a follower that may be positioned adjacent to the peripheral support structure. In these embodiments, it is preferred that the outer edge of the support structure have an annular form. The follower may be raised and lowered by the lifting structure. In some embodiments, these followers are in the form of a slightly arcuate plate that conforms to the curvature of the annular support structure. In the rotating embodiments, one or more wheels extend out from each follower above the annular support structure; and one or more additional wheels extend out from each follower below the annular support structure. As a result, in these embodiments, the wheels of each follower are deployed both above and below the annular support structure, sandwiching the support structure between them. When the lifting structure raises the follower, the wheels that are located below the annular support structure come up underneath and make contact with the lower surface of the annular support structure, transferring the upward motion to the annular support structure thereby raising it upward. Similarly, when the lifting structure lowers the follower, the wheels that are located above the annular support structure come down and make contact with the upper surface of the annular support structure, transferring the downward motion to the annular support structure thereby lowering it. The wheels on the followers are spaced sufficiently to allow the annular support structure to rotate freely with the generally cylindrical support wall, while staying sandwiched between them. All of the components of the system are made of durable preferably metal materials in order to transfer sufficient force to hold and rotate the heavy pipe sections that are placed into the invention.

In the embodiments where the peripheral support structure is not capable of rotational movement, the lift(s) may be attached directly to the support structure. In alternative embodiments, follower(s) or linkage(s) may be provided with the lift(s) to attach the lifts to the peripheral support structure to permit raising and lowering of the support structure. In alternative embodiments, guides may be provided which extend out from each follower above and below the support structure, sandwiching the support structure between them. In these alternative embodiments, the guides may be attached to the peripheral support structure but this is not necessary. When the lifting structure raises the follower in the embodiments where the support structure is sandwiched between upper and lower guides, the guides located below the support structure transfer the upward motion to the support structure thereby raising it. Similarly, when the lifting structure lowers the follower, the guides located above the peripheral support structure come down transferring the downward motion to the support structure thereby lowering it.

It is to be appreciated that in the non-rotating embodiments, the peripheral support structure may be replaced by separate coordinated lifts or lifting structures for each linkage, which raise and lower all of the linkages at the same time for even movement. In these embodiments, followers may be employed, but are not necessary.

Once a subsequent section of pipe is properly secured to first pipe section in the mouse hole, the slips can be released, and the pipe chain lowered until the top of the uppermost pipe section is positioned for engagement by the slips. Then another pipe section may be attached, and so on, until the drill pipe chain has a desired length. At that time, these attached sections of pipe can be removed as a unit from the mouse hole and attached as a unit to the existing drill pipe string.

It is therefore an object of the present invention to provide methods and apparatus for improving the efficiency of drilling operations through improved mouse hole drill pipe support systems.

It is also an object of the present invention to provide methods and apparatus for reducing the time required to set up drill pipe sections or strings prior to installation into the main drill string.

It is also an object of the present invention to provide methods and apparatus for supporting and engaging drill pipe in a mouse hole that allows for multiple drill pipe sections or joints to be attached together before being attached to an existing drill string.

It is also an object of the present invention to provide methods and apparatus for securely engaging and disengaging drill pipe sections inserted into a mouse hole without having to manually insert or remove separate support shims or slips.

It is also an object of the present invention to provide apparatus for supporting and engaging drill pipe in a mouse hole that may be mounted above, below or into the floor of a drill rig.

It is another object of the present invention to provide portable apparatus for supporting and engaging drill pipe in a mouse hole that may be retrofitted onto an existing drill rig floor.

Additional objects of the invention will be apparent from the detailed descriptions and the claims herein.

DETAILED DESCRIPTION

Figure 1:
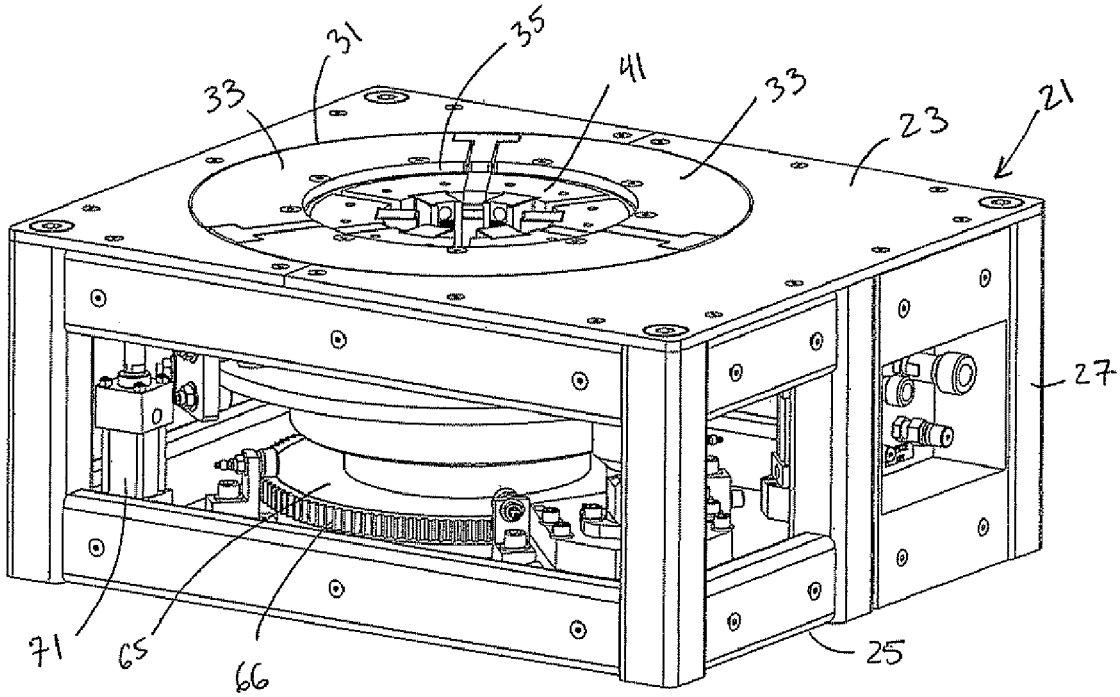
FIG. 1 is a side perspective view of an embodiment of the apparatus of the present invention in a closed position.
Figure 2:
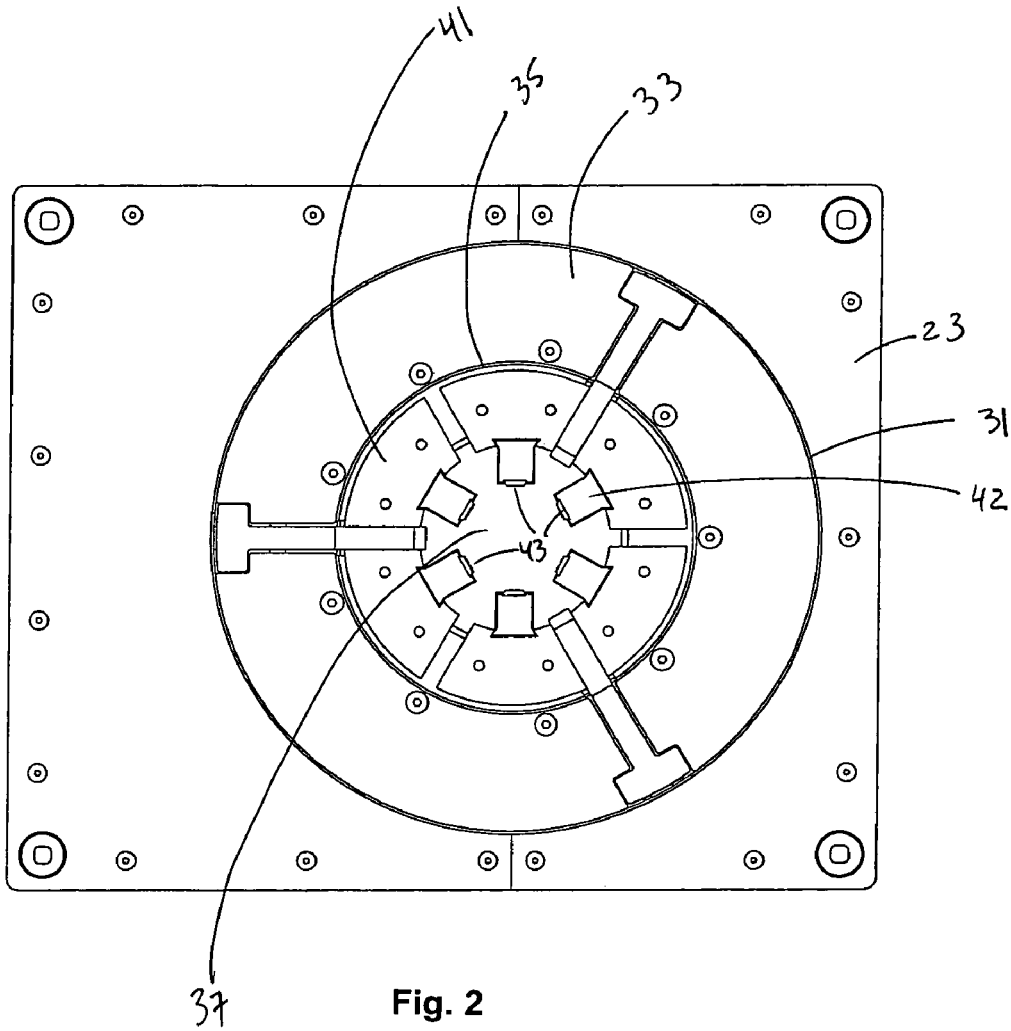
FIG. 2 is a top plan view of the embodiment of FIG. 1.
Figure 4:
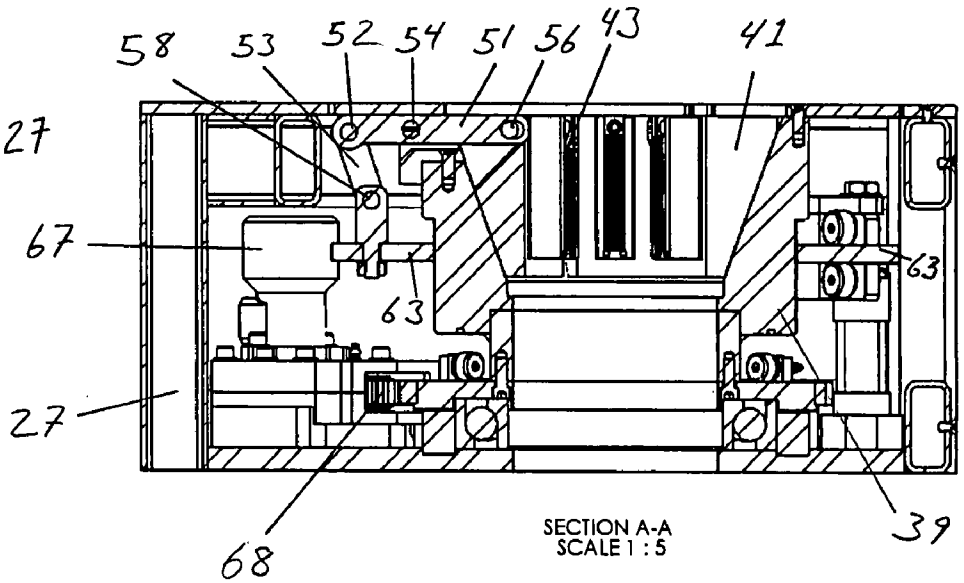
FIG. 4 is a side cross-sectional view along line A-A of FIG. 3.
Figure 3:
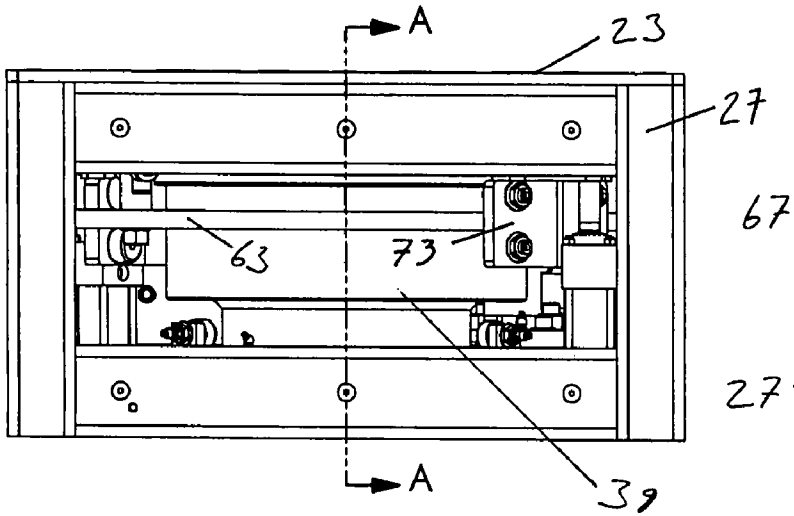
FIG. 3 is a side elevational view of the embodiment of FIG. 1.

Referring to the drawings wherein like reference characters designate like or corresponding parts throughout the several views, and referring particularly to the illustrated embodiments of FIGS. 1-10, it is seen that the illustrated embodiment of the present invention includes a frame 21 having an upper surface 23 and a lower surface 25 separated by a plurality of supports 27. Frame 21 is designed for placement above a mouse hole of a drilling rig. The depth of the mouse hole should be sufficient to accommodate the desired number of pipe sections to be attached together as a unit prior to installation in the main pipe string of the drilling rig. Frame 21 may be installed such that the lower surface 25 rests upon the existing floor of a drill rig, or upon the floor surrounding the mouse hole. Alternatively, frame 21 may be installed such that upper surface 23 is flush with or below the floor of the drill rig or mouse hole. In several embodiments, frame 21 and the components provided therein (described more fully below) are portable and may be removed and transported as a unit.

At least one central opening is provided in upper surface 23. In rotatable embodiments, such as those illustrated in FIGS. 1-2, one or more plates 33 may be provided inside a larger opening 31 defining central opening 35 therein. In these rotatable embodiments, plates 33 preferably have an arcuate shape generally forming a circle so that plates 33 may rotate within opening 31. In some non-rotatable embodiments, plates 33 need not rotate, so they may be of any suitable shape so as to define a central opening 35. In some embodiments, larger opening 31 and plates 23 and/or 33 may be eliminated entirely as shown in FIGS. 14-22.

A generally cylindrical support wall 39 defining a hollow interior is provided inside frame 21 around opening 35. A plurality of slips 41 are deployed in the hollow interior area of wall 39, leaving another smaller opening 37 in the center for receiving a section of pipe. The tops of slips 41 may have a shape that conforms to the shape of opening 35. In alternative embodiments, slips 41 may be of any shape that fits inside opening 35 and cylindrical wall 39 while still providing a central opening 37 for receiving a pipe section. The number and spacing of slips 41 should be established so that they may engage and hold a section of pipe. The inwardly facing surfaces of slips 41 may be provided with frictional surfaces 43 such as skid plates or teeth, which come into direct contact with a drill pipe section when the slips are engaged (closed) around the pipe to hold it firmly in place. In alternative embodiments, removable extensions 42 may be provided on slips 41 that can more easily be removed and replaced when worn and at a lower cost than replacing the slips 41 themselves. In such embodiments, frictional surfaces 43 are provided on the interior surfaces of extensions 42 where they come into contact the drill pipe section.

It is to be appreciated that neither the support wall 39 nor the hollow interior thereof need be of uniform diameter over the length of their longitudinal axes, or that the hollow interior area itself be generally cylindrical. In some embodiments, the diameter of the support wall 39 will be greater in the area in which the slips are positioned than in other areas. It is also to be appreciated that the exterior of support wall 39 may be generally cylindrical as shown in the illustrated embodiments, but that any other suitable shape (square, rectangular, hexagonal, etc.) may alternatively be used.

A plurality of lever assemblies or linkages are provided in conjunction with slips 41. In several embodiments, these assemblies include upper arms 51 that act as levers. One end of each upper arm 51 is pivotally attached to one or more slips 41 at pivot 56. The opposite end of each arm 51 is attached directly or indirectly to an upward/downward motion imparting member. In the illustrated embodiment shown in FIGS. 9 and 10B, it is seen that the opposite end of arm 51 is pivotally attached at 52 to a second arm 53, and second arm 53 is linked at pivot 58 to a movable structure 63. In the illustrated exemplary embodiment, structure 63 is an annular ring that encircles support wall 39; however, it is to be appreciated that in other embodiments structure 63 may be provided in any shape extending around the periphery of wall 39. Each upper arm 51 extends across and is pivotally attached to the top of support wall 39 at 54 forming a lever, with this pivotal attachment 54 at wall 39 acting as the fulcrum. In alternative embodiments, lower arm 53 may be eliminated, and one end of upper arm 51 may be attached directly to an upward/downward motion imparting member such as structure 63. This direct attachment may or may not be pivotal, depending on the type of motion imparting structure used. Structure 63, is moved up and down, either directly or indirectly, by a lift 71 or other device as described more fully below.

Figure 5:
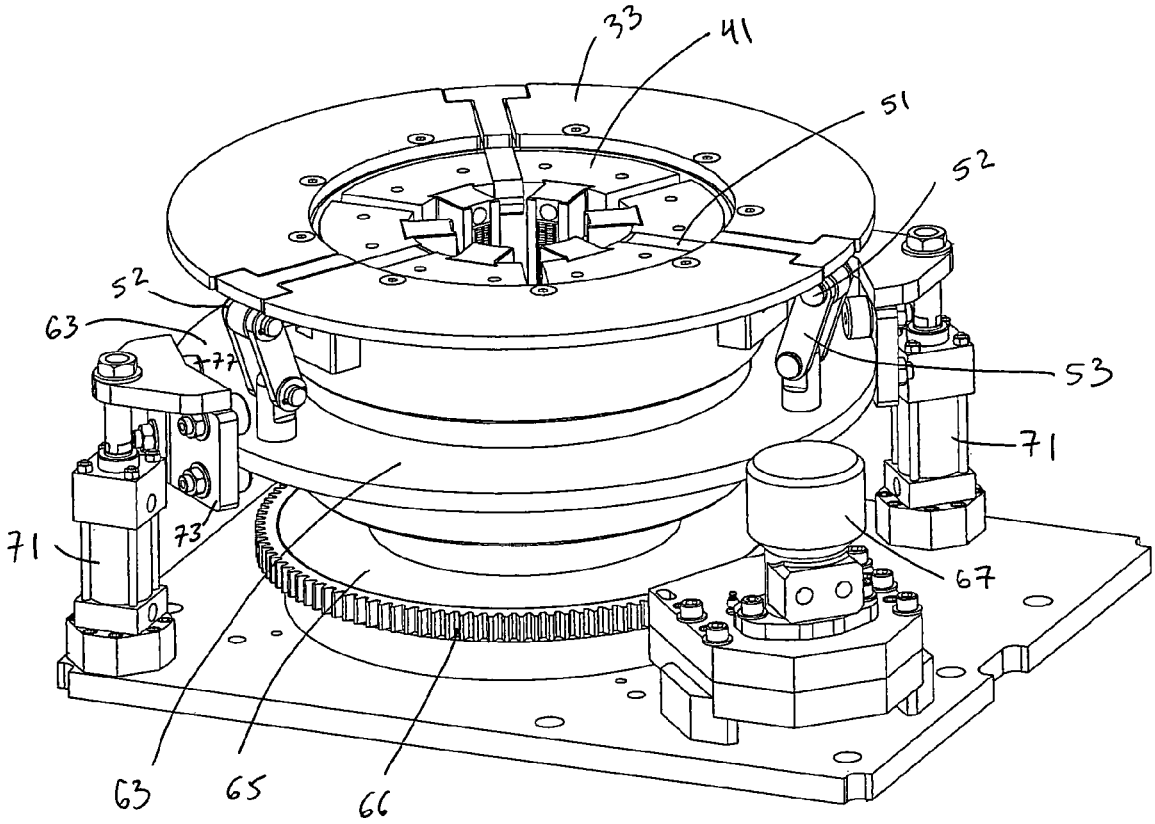
FIG. 5 is a perspective view of the embodiment of FIG. 1 with the support frame removed to show detail.
Figure 5A:
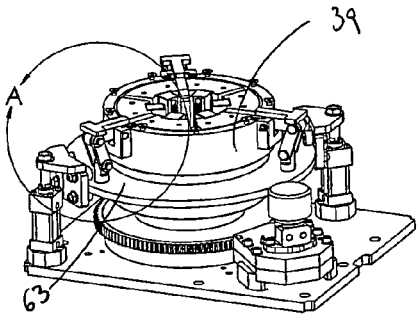
FIG. 5A is a partially cut-away perspective view of the embodiment of FIG. 5.
Figure 5B:
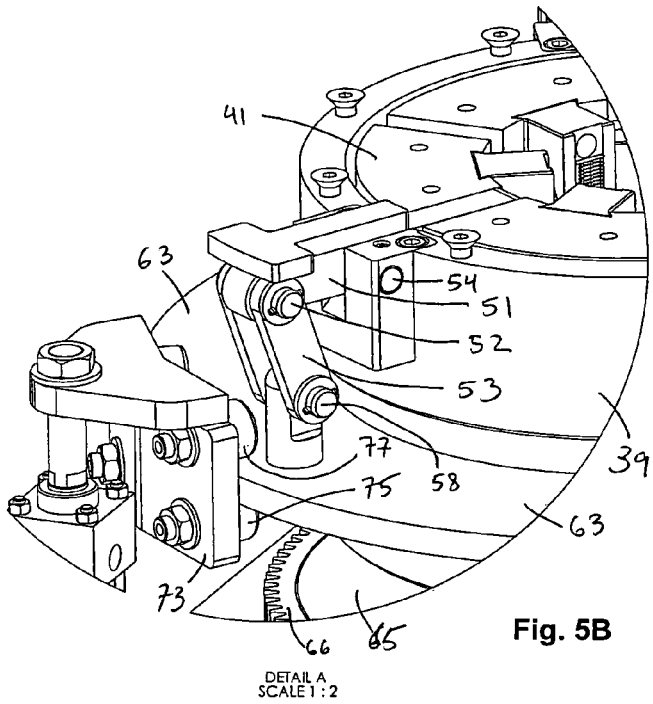
FIG. 5B is a detail view of a portion of the embodiment of FIG. 5A.
Figure 6:
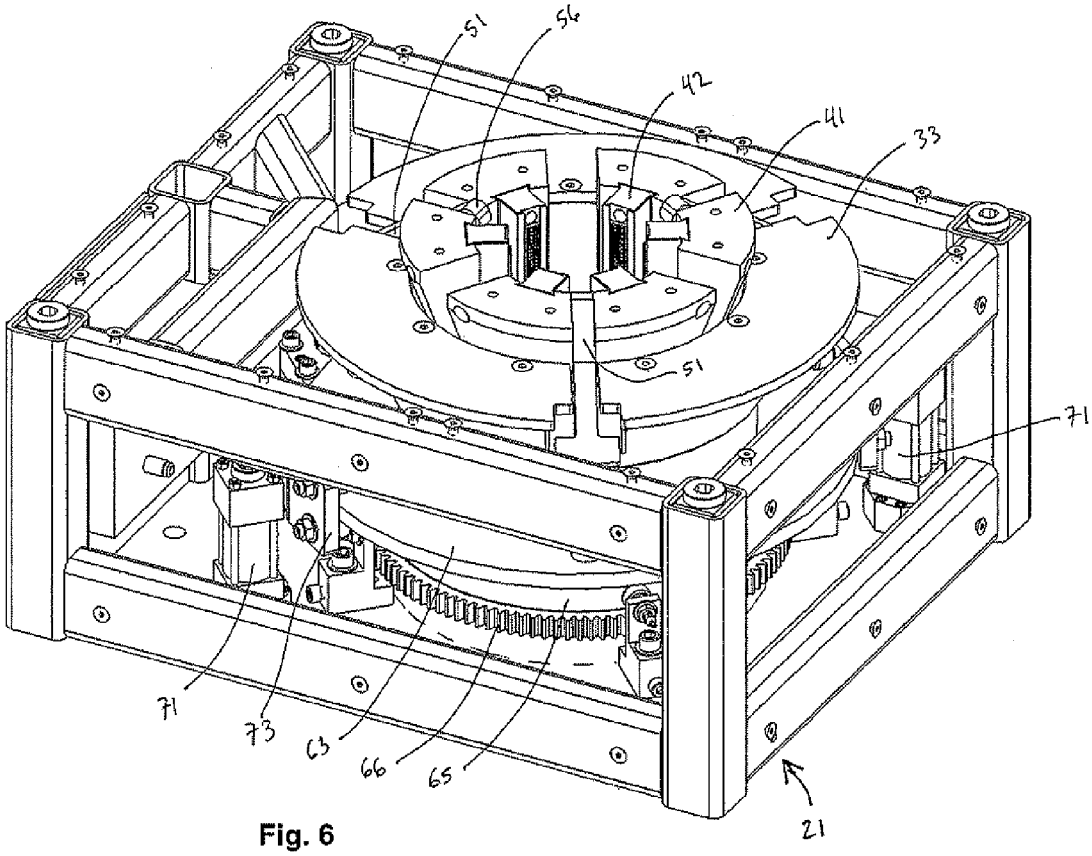
FIG. 6 is a side perspective view of an embodiment of the apparatus of the present invention in an open position.
Figure 7:
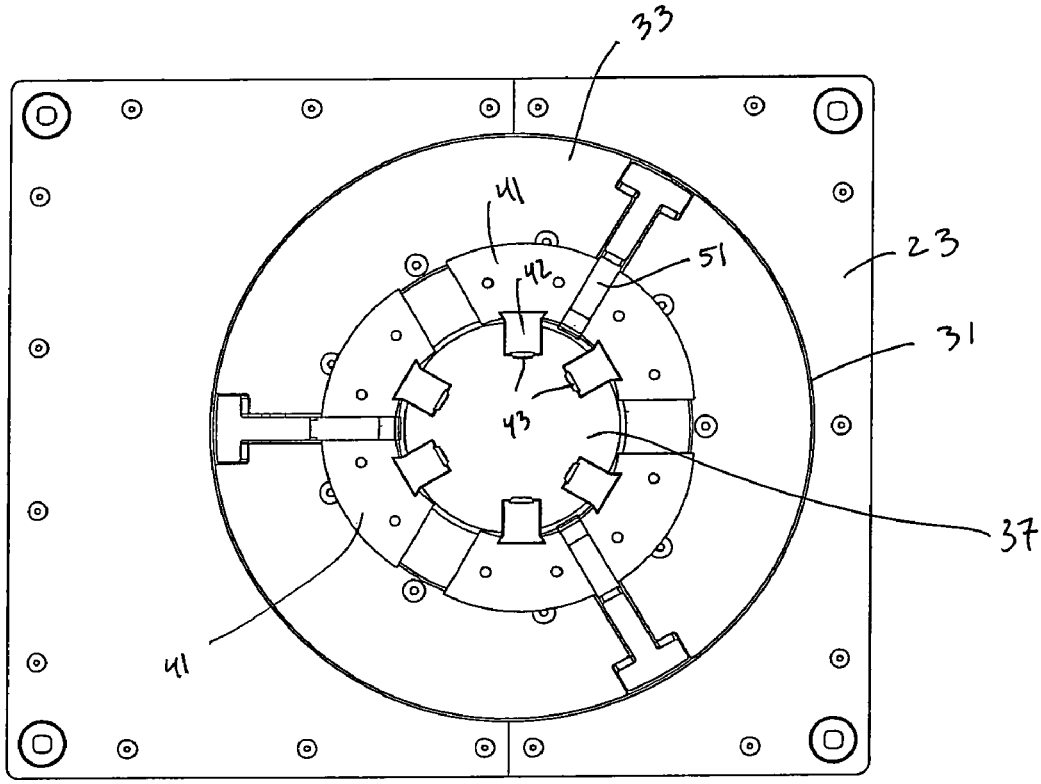
FIG. 7 is a top plan view of the embodiment of FIG. 6.
Figure 9:
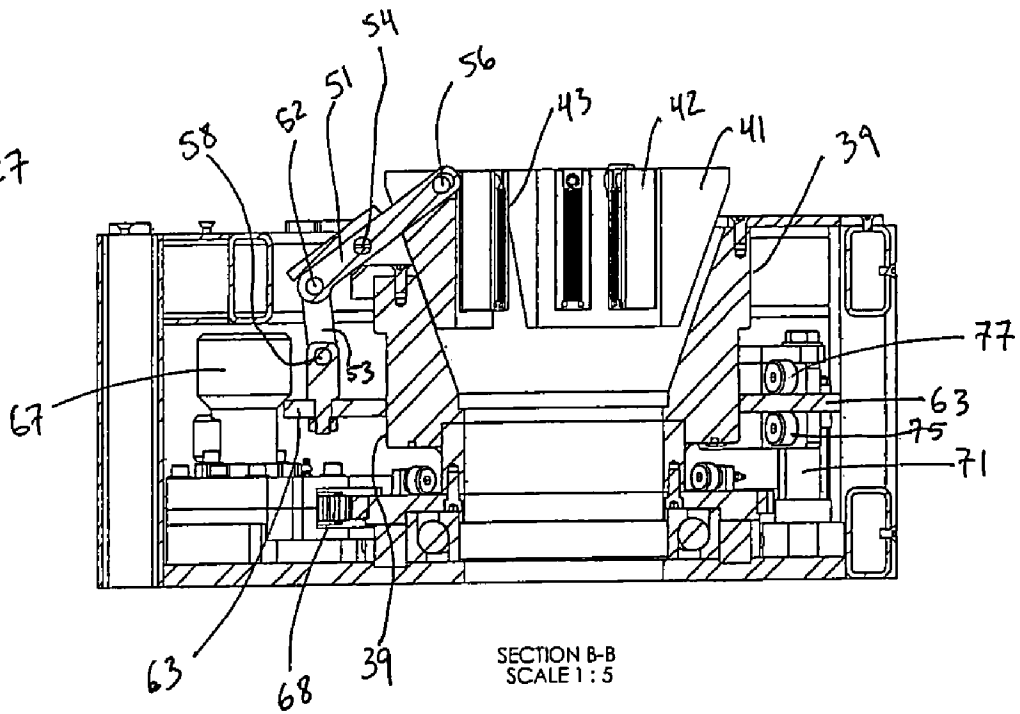
FIG. 9 is a side cross-sectional view along line B-B of FIG. 8.
Figure 8:
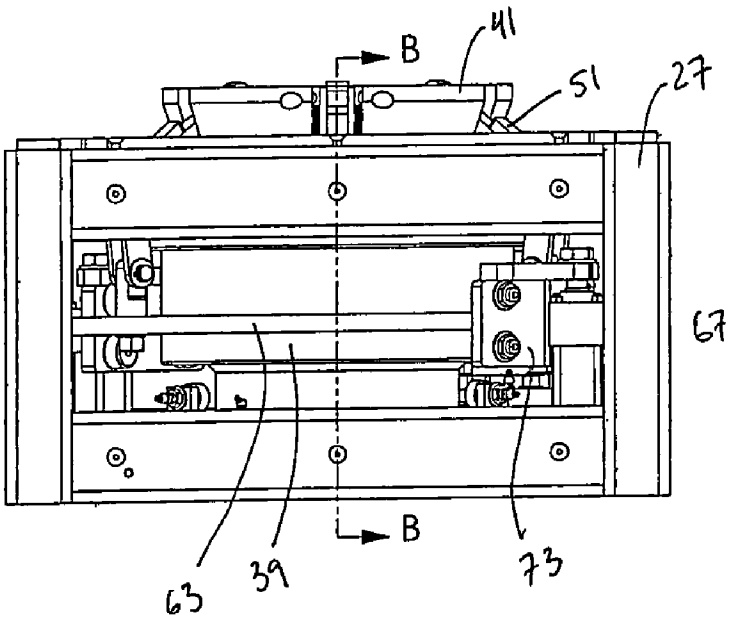
FIG. 8 is a side elevational view of the embodiment of FIG. 6.
Figure 10:
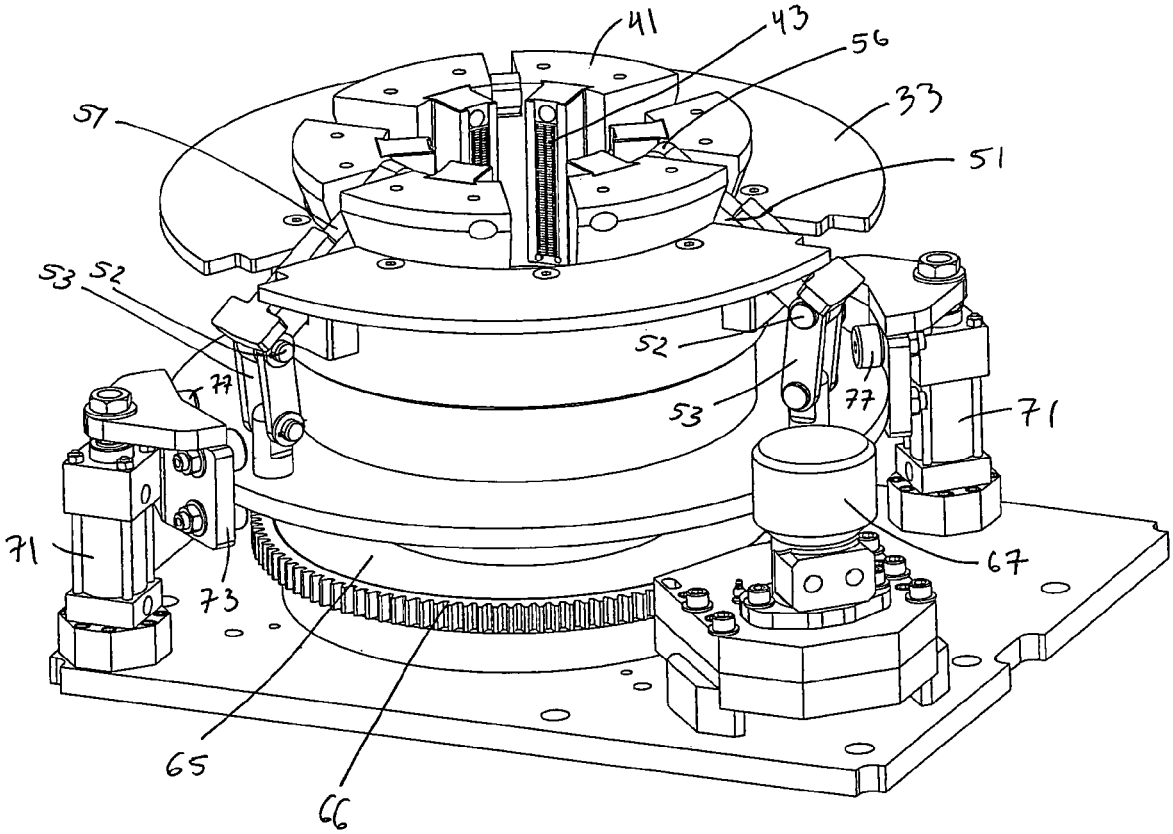
FIG. 10 is a perspective view of the embodiment of FIG. 6 with the support frame removed to show detail.
Figure 10A:
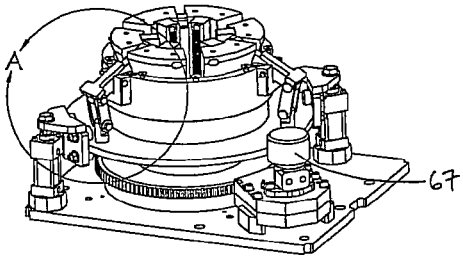
FIG. 10A is a partially cut-away perspective view of the embodiment of FIG. 10.
Figure 10B:
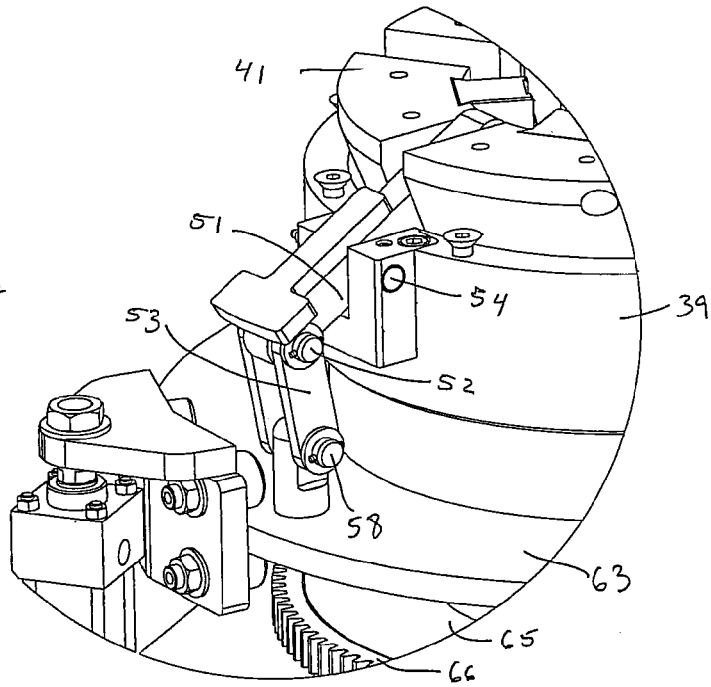
FIG. 10B is a detail view of a portion of the embodiment of FIG. 10A.

Comparing FIG. 5B with FIG. 10B, it is seen that as each upper arm 51 is pulled down at pivot 52 (either directly or through lower arm 53 or the like), arm 51 acts as a lever across pivot attachment 54, such that the opposite end of upper arm 51 at pivot point 56 is raised, thereby raising the slip(s) 41 upward and outward from the central opening 37. This opens the hollow interior of wall 39 for receiving (or releasing) a pipe section as shown in FIGS. 8-10. As the motion imparting device(s) move downward, it forces slips 41 to move upward and outward. As this occurs, the lever assemblies govern the movement of slips 41, pulling them up and away from the center, so that slips 41 move both outward and upward simultaneously. An example of this open position is illustrated in FIGS. 6-10. The farther down the motion imparting member (s) pull upper arms 51 at pivot 52, the higher and farther the opposite ends of upper arms 51 at pivot point 56 and slips 41 are raised upward and outward from the central opening 37. The devices 71 that impart motion to structures such as 63 may be of any suitable form including without limitation electrical, hydraulic, pneumatic, or mechanical, such as motors, pistons, engines or the like.

It is to be appreciated that upward motion from the motion imparting devices at pivots 52 of arms 51 will cause the slips 41 to move downward and inward toward the center of opening 37. In particular, as each motion imparting device moves up, it raises end 52 of upper arm 51, either directly or through lower arm 53 or the like. This causes the other end 56 of the upper arm 51 to travel downward and inward towards the center of the opening 37, bringing the attached slip(s) 41 with it. This motion is used to engage the slips 41 against a pipe section in opening 37, or to bring the slips to a closed position if no pipe is present as shown in the exemplary embodiment of FIGS. 1-5. The motion imparting device(s) impart sufficient force through the lever assemblies to the slips 41 to hold not only the weight of the pipe section engaged by the slips, but also the weight of other pipe sections that may be attached thereto.

It is to be appreciated that upward/downward motion imparting member(s) may be provided in numerous alternative embodiments. In the illustrated embodiments of FIGS. 1-10, a single structure 63 is provided to which each of the lever assemblies is attached. Structure 63 in the form of a peripheral support member that conforms to the outer surface of wall 39. As structure 63 moves downward, it forces the slips 41 to move upward and outward. As this occurs, the arms 51 (and/or linkages 53) attached to the slips govern their movement, pulling them up and away from the center, so that the slips 41 move both outward and upward at the same time. This open position is illustrated in FIGS. 6-10. Then, when structure 63 moves upward, the lever action of the assemblies moves the slips 41 down causing the slips to extend toward the center so that they move downward and inward at the same time. This closed position is illustrated in FIGS. 1-5.

It is to be appreciated that in some embodiments, separate up/down motion imparting members may be provided for each lever assembly (as shown in FIGS. 14-17), or that different groups of lever assemblies may be operated by different motion imparting members. It is to be appreciated that different combinations of motion imparting devices and lever assemblies may also be used, and different linkages or combinations of linkages may be employed between devices 71 and lever arms 51. When multiple motion imparting devices are used, the motion of the lever assemblies should be coordinated in order to impart consistent motion to each linkage, in order to raise and lower the slips 41 in a uniform manner.

In the non-rotating embodiments, it is not necessary for slips 41 to rotate around opening 37 to rotate an engaged pipe section. Thus, the upward/downward motion may be imparted directly to each lever assemblies using its own lift 71 that may be more directly connected to the lever assembly, eliminating member 63. An example of such lifting assemblies is shown in FIGS. 14-17.

Figure 11:
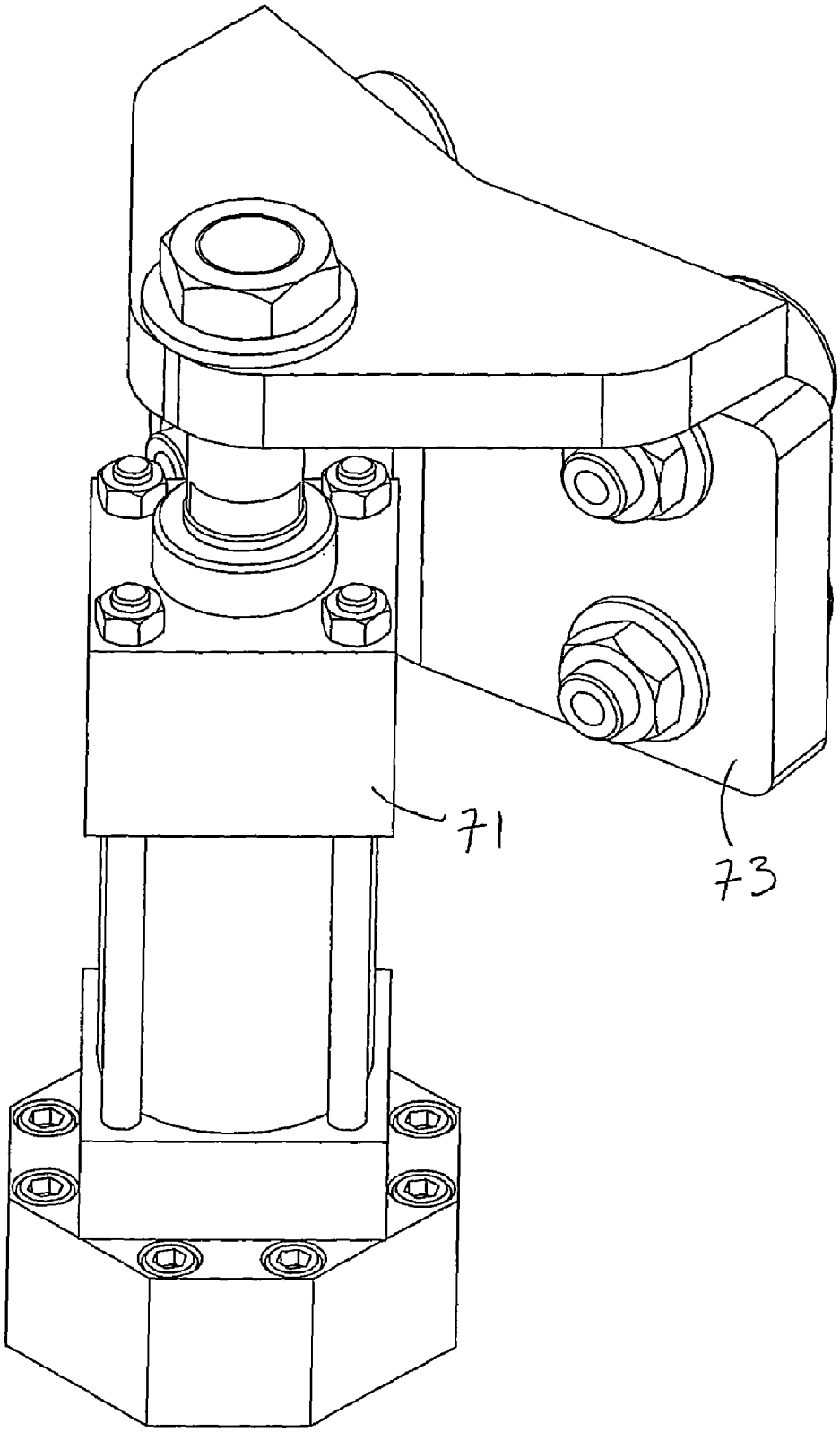
FIG. 11 is a rear perspective detail view of an embodiment of a lift and follower of the present invention.
Figure 12:
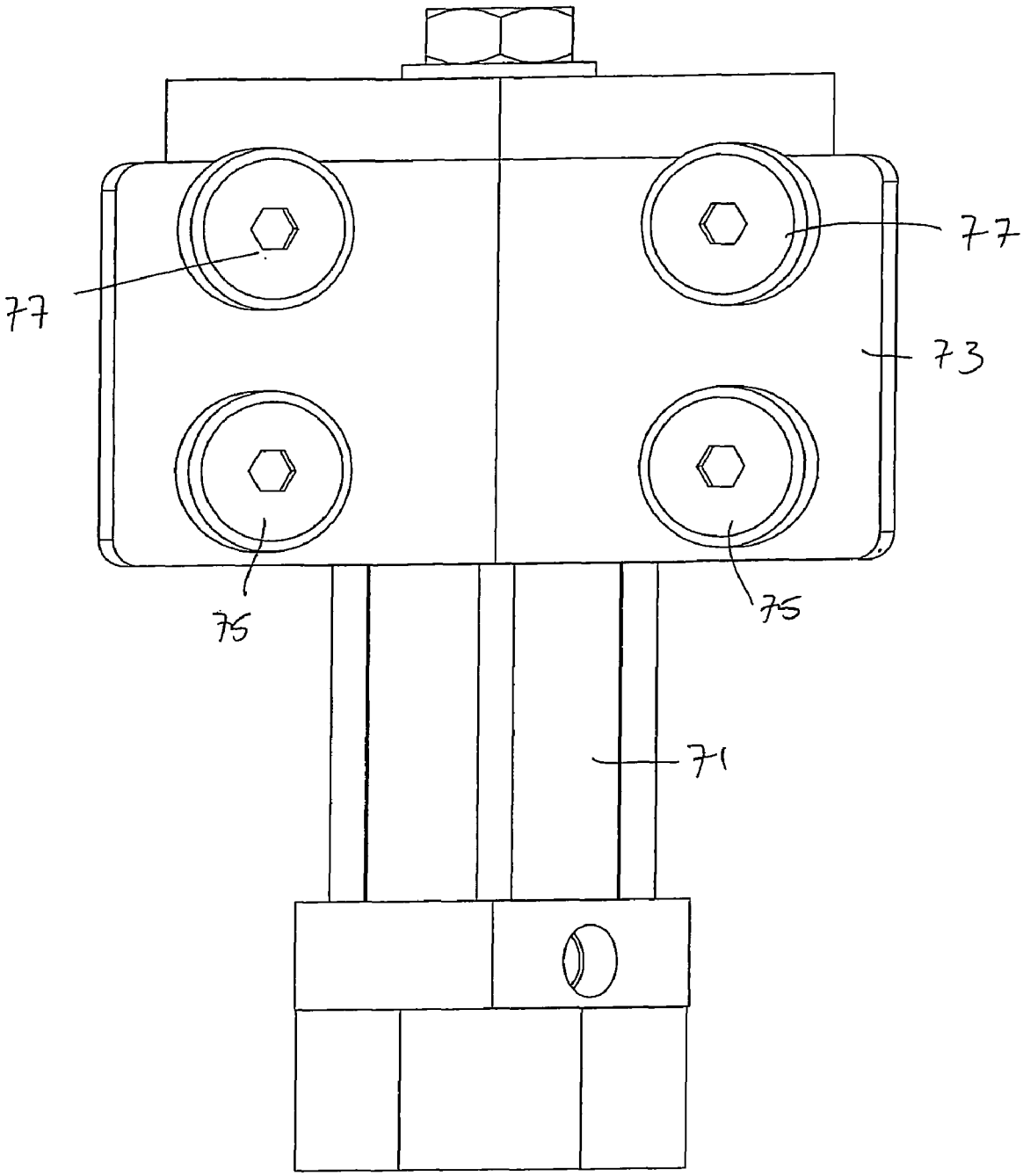
FIG. 12 is a front perspective detail view of an embodiment of a follower of the present invention.
Figure 13:
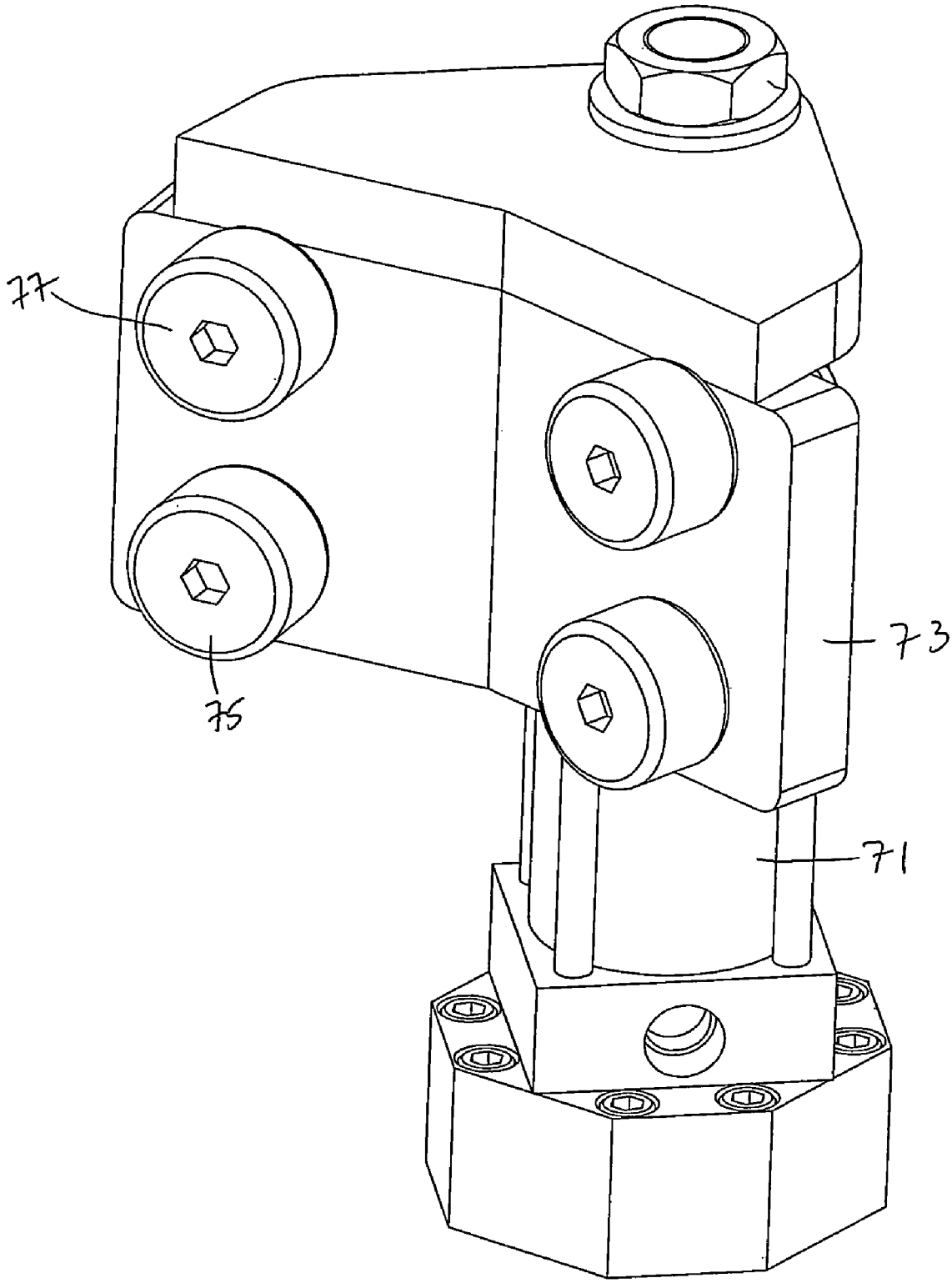
FIG. 13 is a side perspective detail view of an embodiment of a follower of the present invention.
Figure 14:
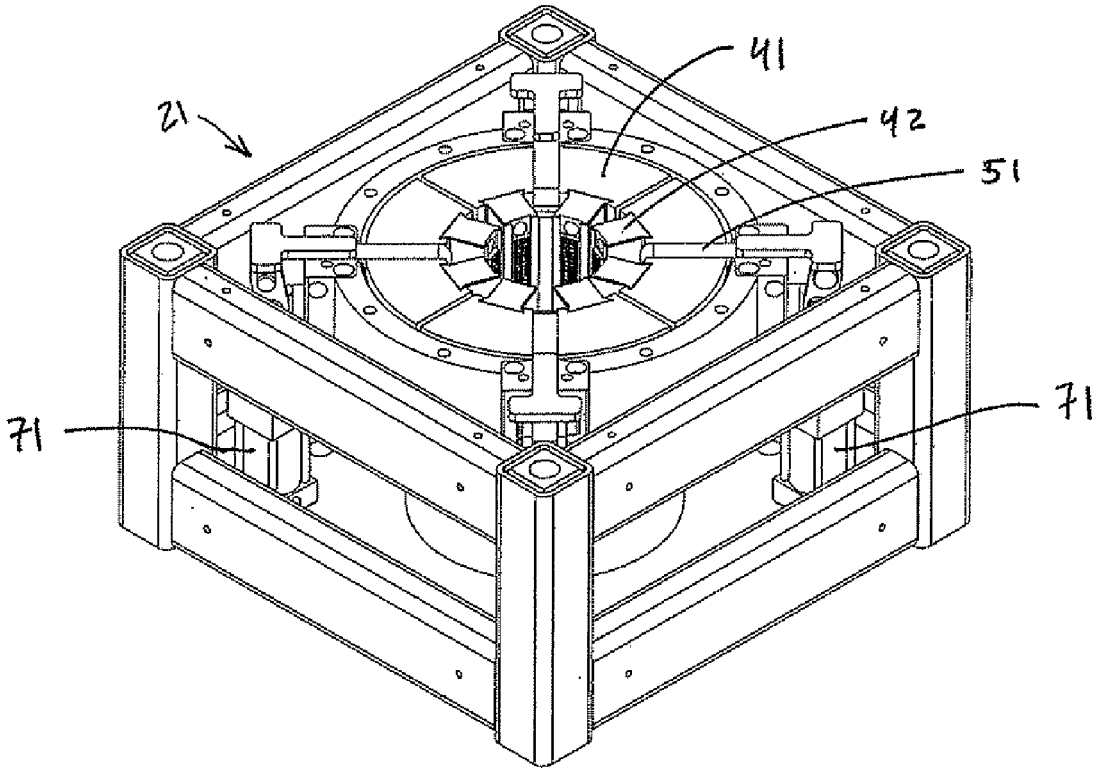
FIG. 14 is a side perspective view of an alternate embodiment of the apparatus of the present invention in a closed position.
Figure 15:
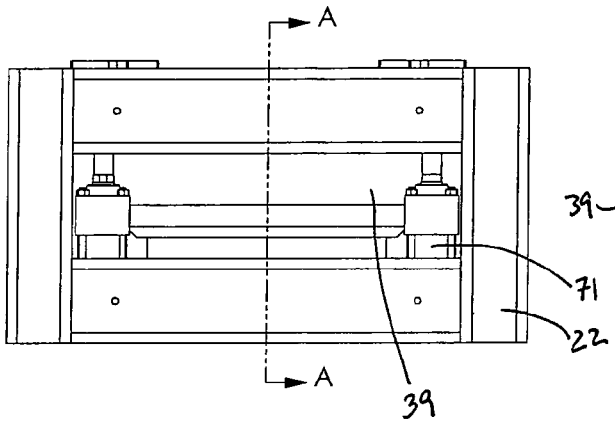
FIG. 15 is a side elevational view of the embodiment of FIG. 14.
Figure 16:
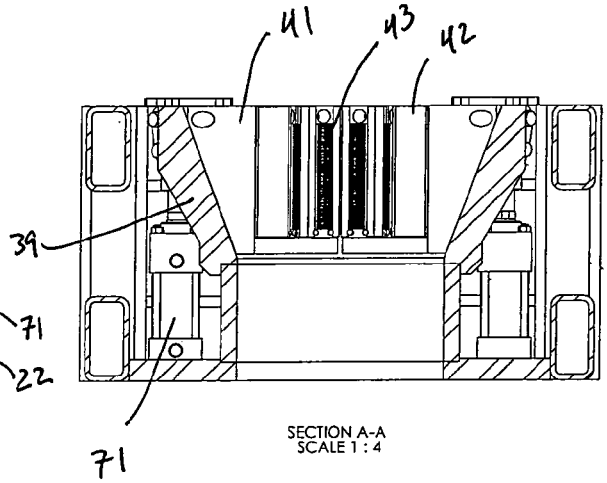
FIG. 16 is a side cross-sectional view along line A-A of FIG. 15.
Figure 17:
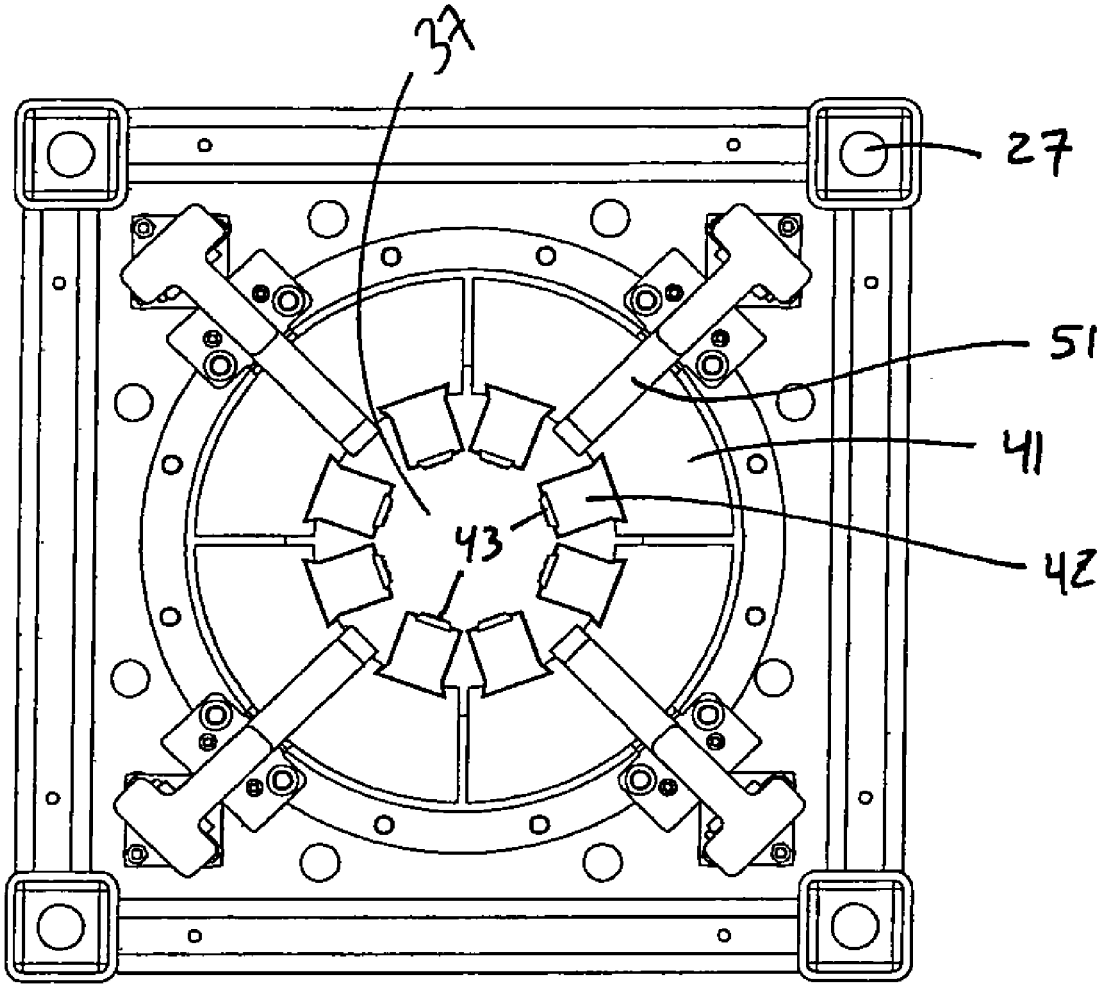
FIG. 17 is a top plan view of the embodiment of FIG. 14.
Figure 18:
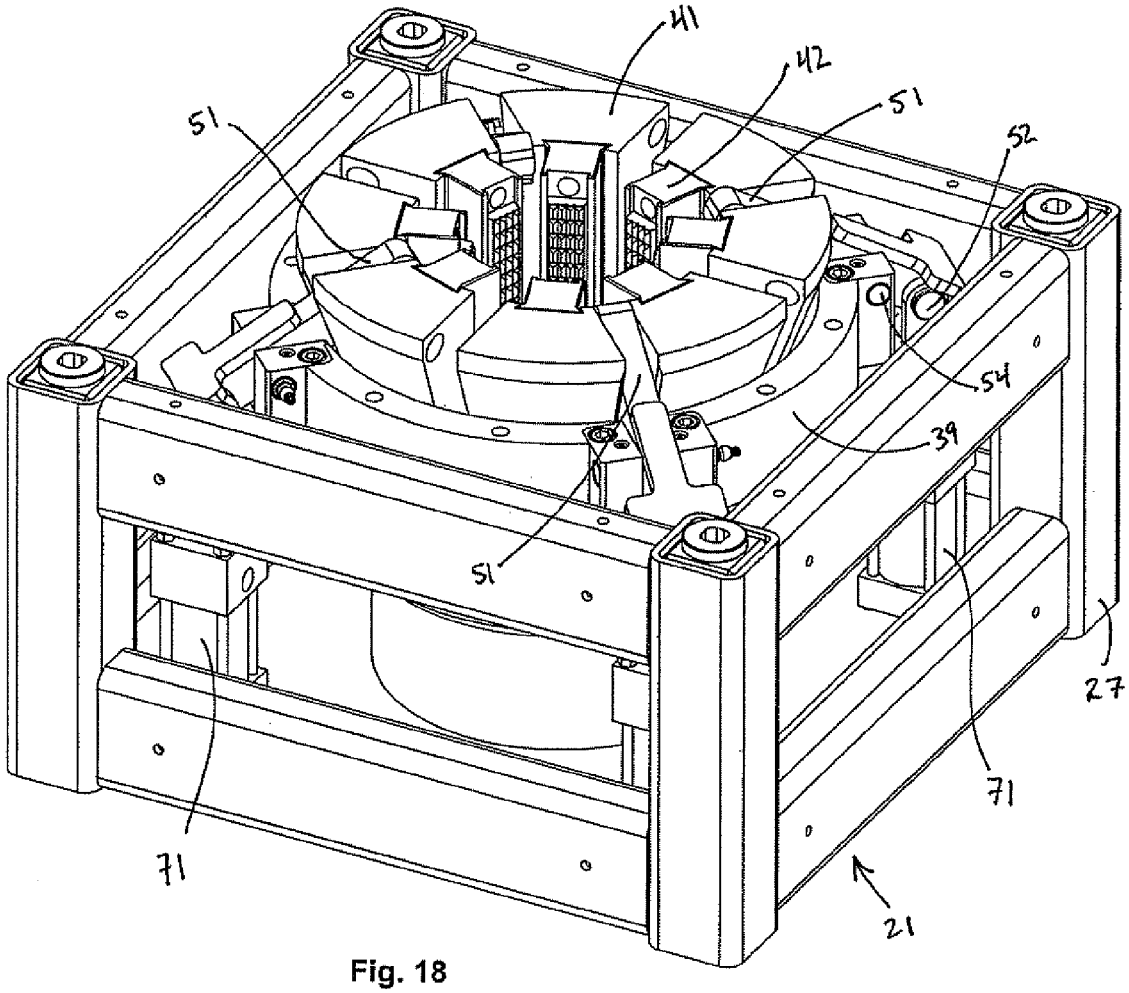
FIG. 18 is a detailed perspective view of the embodiment of FIG. 14 in a partially opened position.
Figure 19:
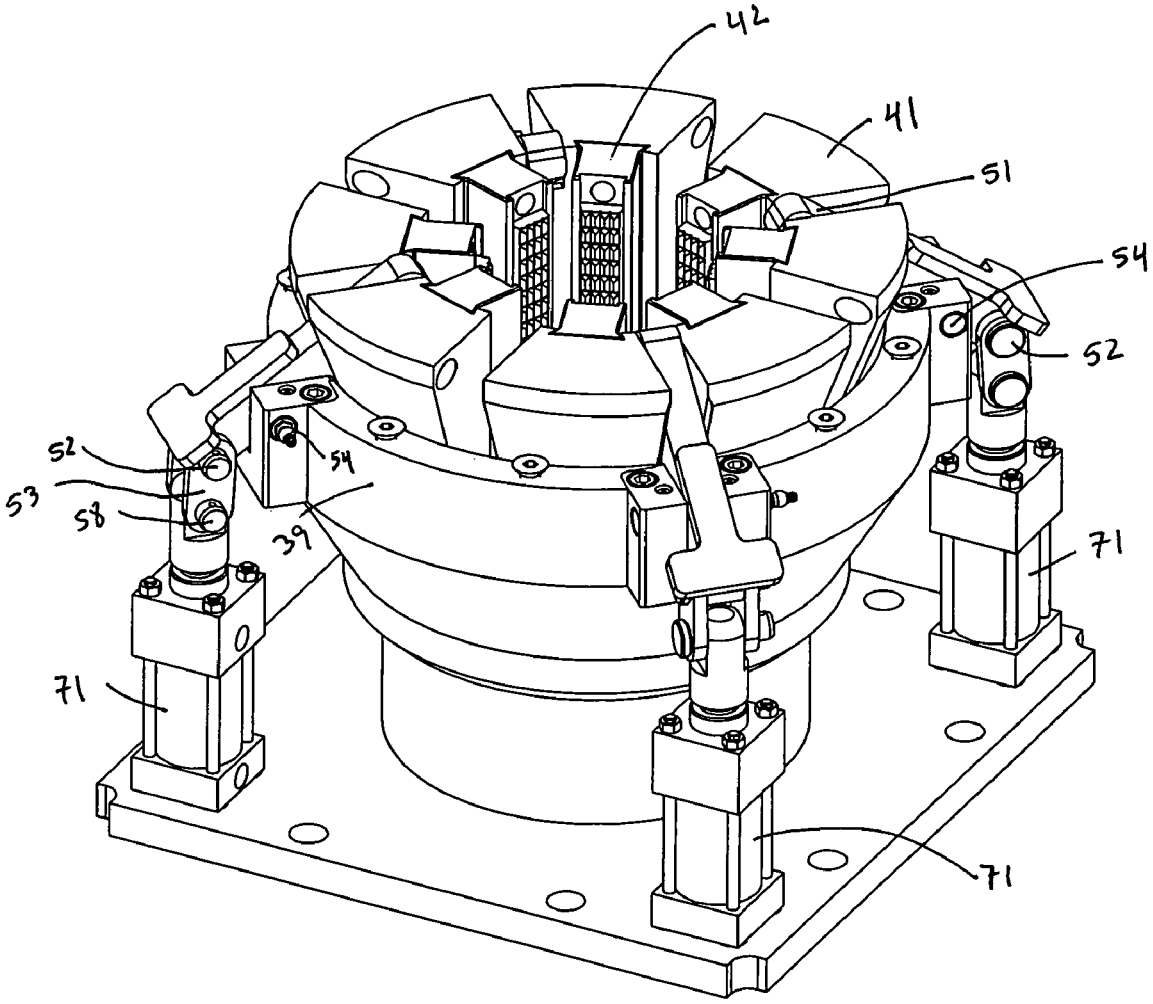
FIG. 19 is a detailed perspective view of the embodiment of FIG. 18 with the frame removed.
Figure 20:
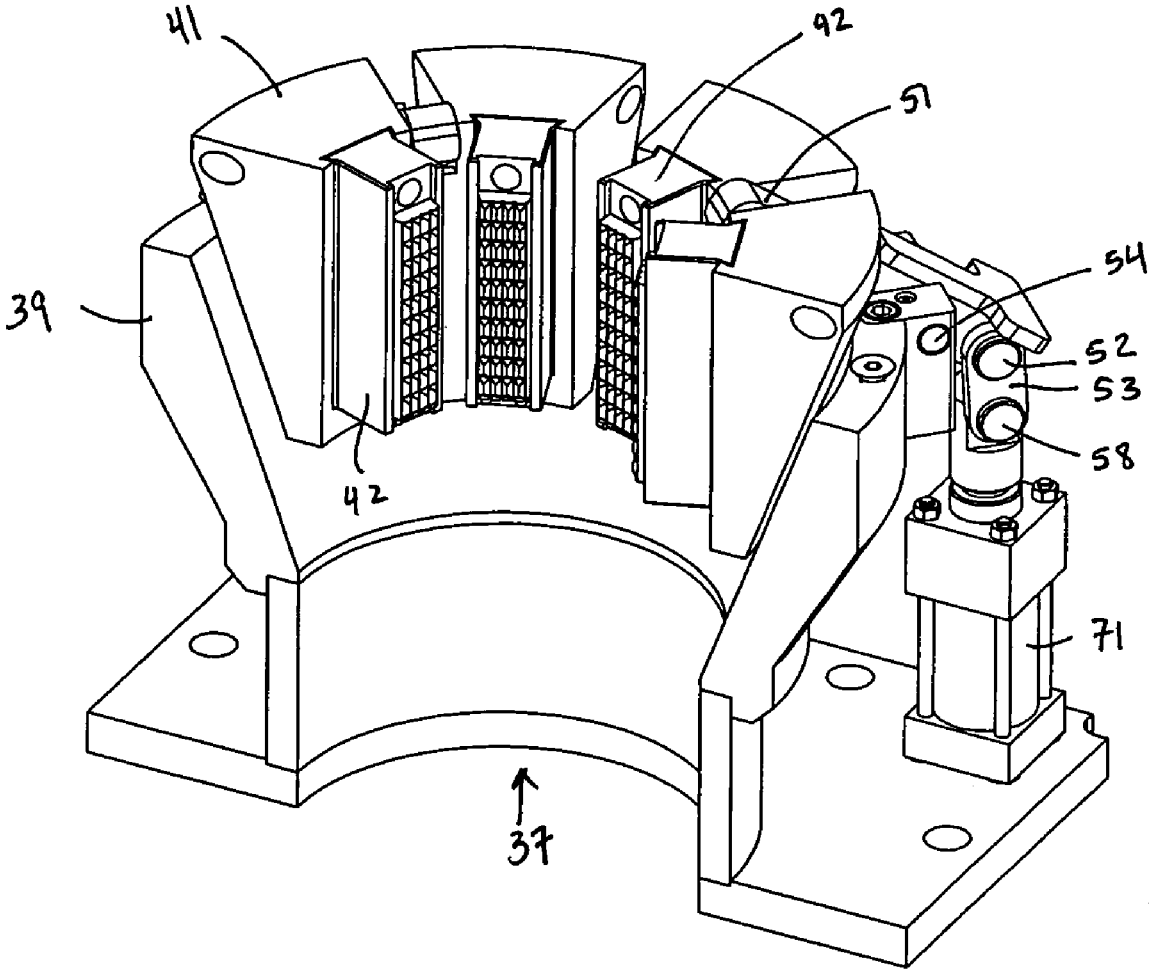
FIG. 20 is a cross-sectional view of a portion of FIG. 19.
Figure 21:
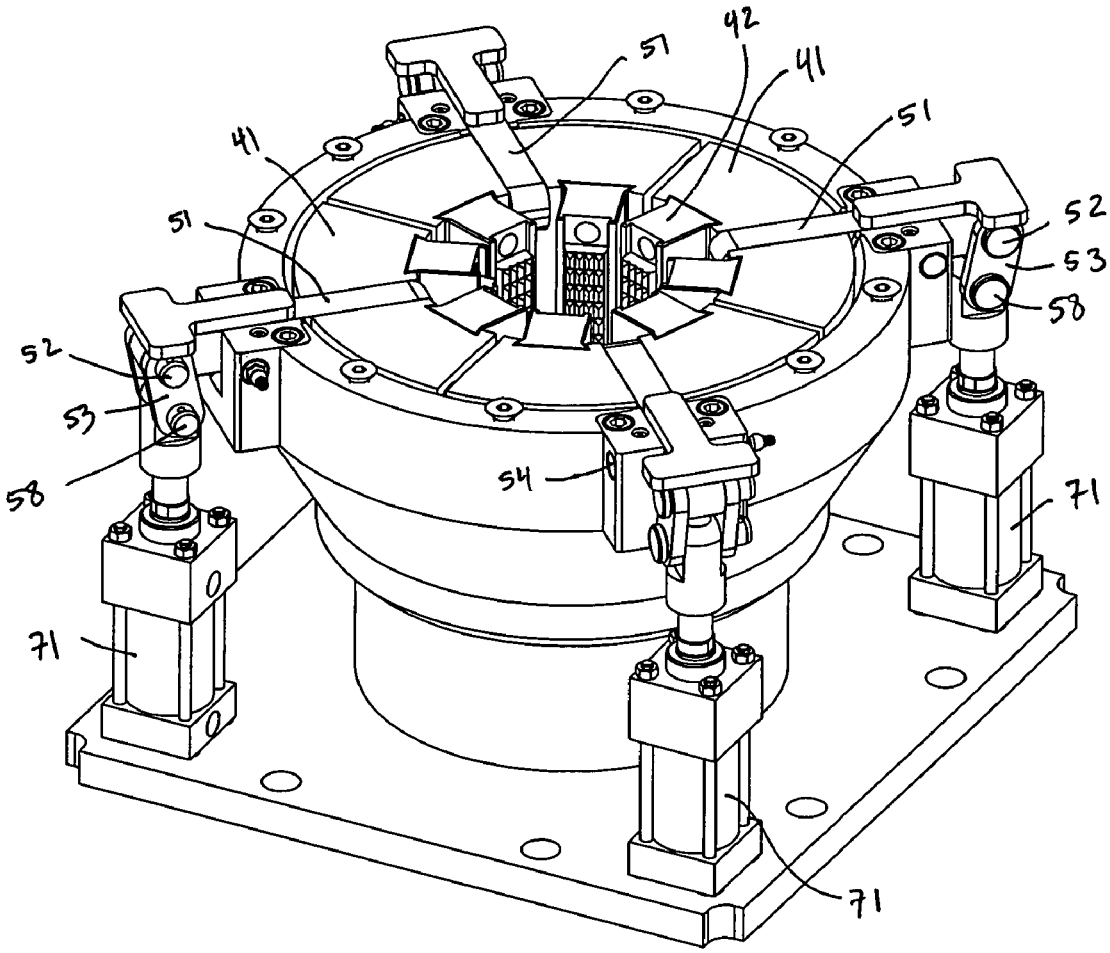
FIG. 21 is a detailed perspective view of the embodiment of FIG. 14 in a closed position with the frame removed.
Figure 22:
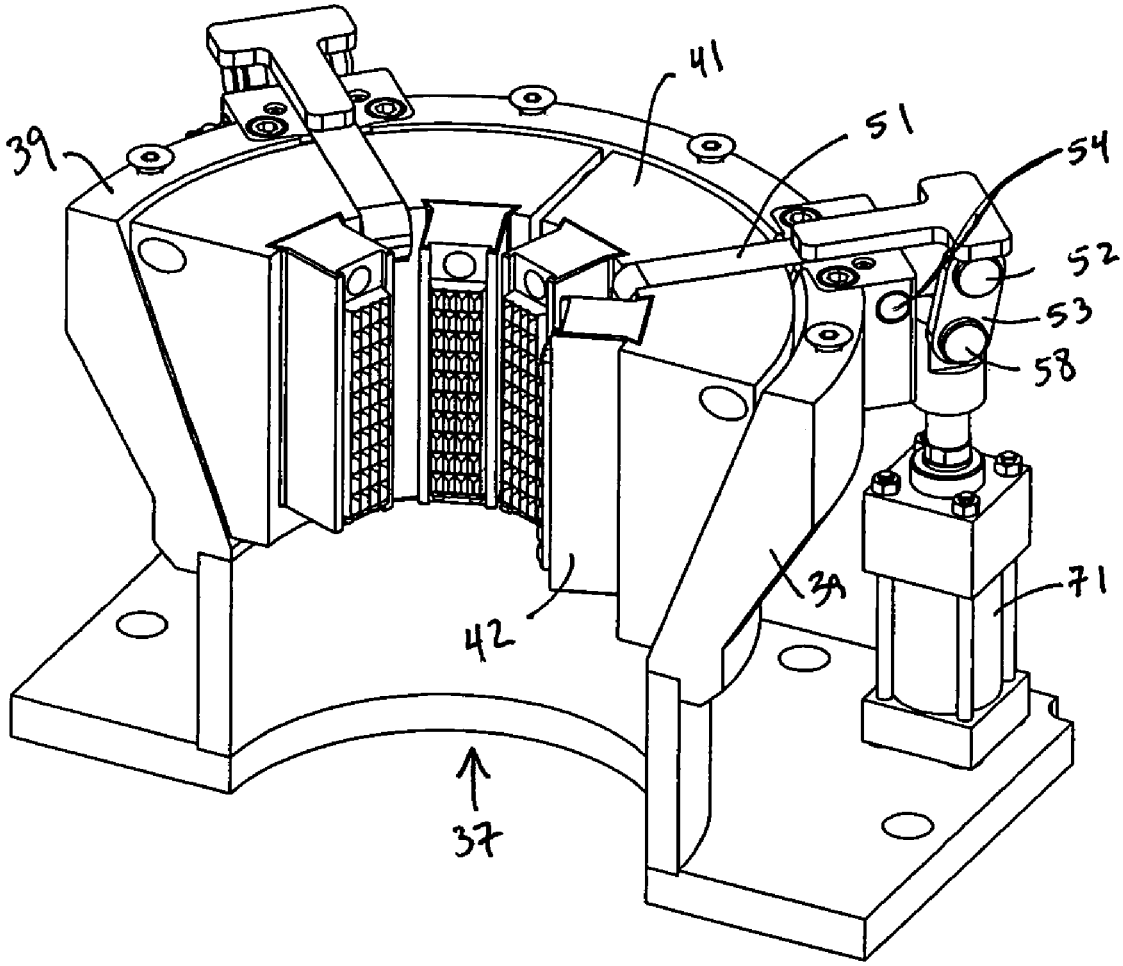
FIG. 22 is a cross-sectional view of a portion of FIG. 21.

However, in the rotatable embodiments, such as that shown in FIGS. 1-10, it is generally desirable to separate the upward/downward motion imparting members from the remaining rotatable parts of the invention so that the slips (and the structures associated with them—levers, cylindrical wall, etc.) may rotate freely and independently of the upward/downward motion imparting members. An example of how this separation is accomplished is illustrated in the embodiments of FIGS. 1-13. In these illustrated embodiments, it is seen that upward and downward movement is imparted to the lever assemblies and structure 63 by a plurality of lifts 71. Each lift 71 engages structure 63 in a way that allows structure 63 to rotate along with wall 39, the lever assemblies, and slips 41 independent of the lifts 71 themselves. As shown in FIGS. 10 and 13, each lift 71 is provided with a follower 73 that is positioned immediately adjacent to structure 63. Followers 73 are raised and lowered by lifts 71. As exemplified in FIGS. 11-13, followers 73 are in the form of angled or slightly arcuate plate(s) that conform to the curvature of the annular support structure 63. One or more rotatable members 75 extend out from each follower 73 below the annular support structure; and one or more additional rotatable members 77 extend out from each follower 73 above the annular support structure. As a result, the rotatable members of each follower are deployed both above 77 and below 75 the annular support structure 63, sandwiching the support structure between them. Members 75 and 77 are rotatable in order to minimize friction while in contact with annular support structure 63 when it is rotated along with wall 39, the lever assemblies and the slips. It is to be appreciated that the followers may be provided in different forms so as to impart raising and lowering movement to annular support structure 63. For example and without limitation, followers may be in the form of posts, brackets, webbing or the like; and members 75 and 77 may be provided in the form of plates, bearings or even gears with teeth that intermesh with corresponding teeth on structure 63. In other embodiments, a single hydraulic or pneumatic source may operate a plurality of lifts, each lift being connected to a follower adjacent to the annular support structure 63.

In the exemplary illustrated embodiments of FIGS. 1-13, when a lift or lifting structure 71 raises a follower 73, the rotatable members 75 that are located below the annular support structure 63 come up underneath and make contact with the lower surface of the annular support structure 63, transferring the upward motion to the annular support structure thereby raising it upward (and closing the slips 41), as shown in FIGS. 1-5. Similarly, when the lifts or lifting structures 71 lower the followers 73, the rotatable members 77 that are located above the annular support structure 63 come down and make contact with the upper surface of the annular support structure, transferring the downward motion to the annular support structure thereby lowering it (and raising the slips 41), as shown in FIGS. 6-10. The rotatable members 75, 77 on the followers 73 are spaced sufficiently to allow the annular support structure 63 to rotate freely with wall 39, while staying sandwiched between them.

Upward and downward motion must be imparted to annular support structure 63 in a way that allows this structure to stay relatively level. This is important in order to cause uniform movement of the slips 41 resulting in firm, even engagement of a pipe section. In several embodiments, this is accomplished by means of one or more motion imparting devices or lifts 71 that are positioned around the annular support structure 63. It is preferred that the annular support structure 63 be lifted from at least two different locations in order to keep structure 63 in a relatively level position as it is raised and lowered. This may be accomplished using a single lifting mechanism that operates two or more lifting structures to lift annular support structure 63. In some embodiments, two lifting structures 71 may be used; in others, three such structures may be used. In the illustrated embodiments, four lifting structures 71 are shown, although any suitable number of lifting structures or lifting locations may be used. It is preferred that the lifting structures or locations be positioned relatively equidistant from each other around the support structure 63 to keep it relatively level. Motion imparting device(s) or lifts 71 may be of any suitable form including without limitation electrical, hydraulic, pneumatic, or mechanical, such as motors, pistons, engines or the like.

In the non-rotatable exemplary embodiment of FIGS. 14-22, support structure 63 has been eliminated; however, it is to be appreciated that in other non-rotational embodiments, a peripheral support structure such as structure 63 may be used to assure uniform movement of the lever assemblies and slips. In rotational embodiments, support structure 63 is capable of rotating in conjunction with wall 39 in order to allow the slips and linkages to be rotated as part of the pipe coupling process.

In other embodiments, support structure 63 is eliminated and motion imparting device(s) 71 are attached or linked more directly to the lever assemblies. Like support structure 63, the motion imparting device(s) will cause the slips 41 to move downward and inward toward the center of opening 37. In particular, as each motion imparting device moves up, it raises upper arm 51 at pivot 52 with or without a lower arm 53. This causes upper arm 51 at pivot point 56 to travel downward and inward towards the center of the central opening 37, bringing slip(s) 41 with it. This motion is used to engage the slips 41 against a pipe section in the opening, or to bring the slips to a closed position if no pipe is present. The motion imparting device(s) 71 impart sufficient force to slips 41 to hold not only the weight of the pipe section engaged by slips 41, but also the weight of other pipe sections attached thereto. It is to be appreciated that in rotatable embodiments of the invention, motion imparting devices 71 may be separated from the lever assemblies to allow rotation, while still providing the desired upward/downward motion.

In alternative embodiments, a separate motion imparting device 71 may be provided with each lever assembly, and/or with pairs of linkage assemblies, and/or in other combinations. The movement of these motion imparting devices 71 should be coordinated in order to impart consistent motion to all lever assemblies, in order to raise and lower the slips 41 in a uniform manner.

In other embodiments, lifts 71 are pivotally connected directly or indirectly to the lever assemblies or linkages, whichever is the case, so structure 63 and separate followers 73 are not required.

The rotatable embodiments of FIGS. 1-10 illustrate embodiments of the invention where the engagement/slip assembly rotates a first engaged drill pipe section to be joined with a second drill pipe section which is in a fixed position. In the rotational embodiments, rotational movement is imparted to the support structure 63 which rotates in conjunction with the support wall 39, thereby rotating slips 41 and the engaged drill pipe section around the axis defined by the central opening 37 and wall 39. In some of these rotatable embodiments, wall 39 and support structure 63 are attached directly or indirectly to a rotating mechanism, such as a gear. In the illustrated exemplary embodiment, a large gear structure 65 is attached to or incorporated into wall 39 having a set of cogs or teeth 66 around its circumference. In these embodiments, a motor or other rotational member 67 having a smaller corresponding and interengaging gear 68 is provided adjacent to the large gear 65, such that operation of the motor or other rotational member imparts motion from the smaller gear to the larger one, thereby rotating support wall 39, annular support structure 63 and everything attached to it, including the slips 41 and lever assemblies 51 and/or 53. While a gear has been illustrated as a means of imparting rotation, other means may also be employed such as a belt system, chain driven sprockets, direct drive motor(s), or the like.

In use, the slips 41 are retracted to an outward and upward position, opening the central opening 37 so that a section of pipe may be lowered through the central opening and into the mouse hole below. Once the pipe section has been lowered to a desired position into the mouse hole, the annular support structure or other motion imparting device(s) or lifts are activated to compress the slips 41 and/or the frictional surfaces 43 against the surface of the pipe. The force of the compression of the slips against the pipe section holds it in place. Because of the generally radial inward-outward motion of the slips, generally any pipe section having a diameter that is smaller than the opening 37 provided by the retracted slips may be engaged. Slips of different sizes or shapes may be used to change the size and/or shape of this opening at setup, and/or extensions 42 may be attached to the slips. However, once the slips (with or without extensions) have been installed, it is generally not necessary to insert, remove or change them out during operations.

Once the first section of pipe has been grasped by the slips, another section of pipe is then positioned adjacent to the pipe being held by the slips. In the stationary embodiments of the invention, the slips hold the pipe section in a fixed position, and rotational movement is supplied from an external source to join the pipe sections together. In the rotational embodiments of the invention, the rotational movement is imparted to the support wall 39 and/or support structure 63 which rotates the linkages and slips. This causes the held section(s) of pipe to rotate relative to the new section, causing them to be joined together. The slips are then retracted by downward movement of the annular support structure or other motion imparting device(s) or lifts, allowing the pipe section to be removed, or lowered further into the mouse hole and engaged again. The process may then be repeated for subsequent pipe sections. When enough pipe sections are connected together in the mouse hole, the string of sections is removed and attached as a group to the main string of the drill rig.

It is to be understood that variations and modifications of the present invention may be made without departing from the scope thereof, and that different combinations of the various features identified herein are contemplated within the scope of the invention. It is also to be understood that the present invention is not to be limited by the particular embodiments described or illustrated herein, but only in accordance with the appended claims when read in light of the foregoing specification.

What is claimed is:

1. A drill pipe support system comprising:

a. a support frame having a central opening extending therethrough;

b. a wall inside said frame extending around said opening defining a hollow interior area;

c. a plurality of slips movably deployed in said hollow interior area; and d. a plurality of lever assemblies for extending and retracting said slips, each lever assembly comprising an arm extending through a slot in said wall, each arm comprising (i) a proximal end operably attached to at least one of said slips, (ii) a central section pivotally engaged with said wall, and (iii) a distal end operably associated with at least one structure, said structure being capable of providing upward and downward movement to the distal ends of said arms.

2. The support system of claim 1 wherein a second arm is provided in each lever assembly between each first arm and said at least one structure, wherein one end of each second arm is pivotally attached to the distal end of the first arm, and an opposite end of each second arm is operably associated with a fixed location on said at least one structure.

3. The support system of claim 1 wherein said at least one structure is a single peripheral support structure provided around the outside of said wall, said structure being movable in an upward and downward direction relative to said wall, and said structure being operably associated with at least one motion imparting member.

4. The support system of claim 3 wherein each lever assembly comprises at least two arms, the second of each of said arms being pivotally attached at one end to the distal end of the first of said arms, and opposite ends of the second of said arms being operably associated with a fixed location on said peripheral support structure.

5. The support system of claim 3 wherein said at least one motion imparting member is provided in the form of a lift for raising and lowering said peripheral support structure.

6. The support system of claim 5 wherein a plurality of lifts are provided for raising and lowering said peripheral support structure in a uniform fashion.

7. The support system of claim 6 wherein each lift includes at least one follower that is deployed immediately adjacent but not attached to said peripheral support structure for raising and lowering said peripheral support structure while allowing said peripheral support structure to rotate.

8. The support system of claim 7 wherein each follower is provided with at least one rotatable member deployed above said peripheral support structure, and at least one rotatable member deployed below said peripheral support structure.

9. The support system of claim 1 wherein a separate motion imparting member is provided for each lever assembly.

10. The support system of claim 1 wherein an annular gear member is provided around said wall, and a second gear member is attached to a rotation imparting member, the second gear member being engaged with said annular gear member for imparting rotational movement to said wall.

11. The support system of claim 1 wherein each slip includes a frictional surface facing the hollow interior area.

12. The support system of claim 1 wherein an extension is provided on each slip, and each extension includes a frictional surface facing the hollow interior area.

13. In combination, an earthen hole and a drill pipe support system comprising:

a. a generally vertically oriented hole in the earth having a width large enough to receive a vertically oriented section of drill pipe, and a depth that is sufficient to receive at least two attached drill pipe sections;

b. a support frame having a central opening extending therethrough axially positioned above said hole;

c. a wall inside said frame extending around said opening defining a hollow interior area;

d. a plurality of slips movably deployed in said hollow interior area; and e. a plurality of lever assemblies for extending and retracting said slips, each lever assembly having an arm extending through a slot in said wall, each arm having proximal end operably attached to at least one of said slips, a central section pivotally engaged with said wall, and a distal end operably associated with at least one structure, said structure being capable of providing upward and downward movement to the distal ends of said arms.

14. The combination of claim 13 wherein said support frame is attached to a floor of a drill rig platform in at a position selected from the group of on top of said floor, below said floor, and integrated into said floor.

15. The support system of claim 13 wherein a peripheral support structure is provided around the outside of said wall, said peripheral support structure being movable in an upward and downward direction relative to said wall, and wherein the distal end of each of said first arms is operably associated with said peripheral support structure, said peripheral support structure being operably associated with said at least one motion imparting member.

16. The support system of claim 13 wherein an annular gear member is provided around said wall, and a second gear member is attached to a rotation imparting member, the second gear member being engaged with said annular gear member for imparting rotational movement to said wall.

17. The support system of claim 13 wherein said at least one motion imparting member is provided in the form of a plurality of lifts for raising and lowering said peripheral support structure in a uniform fashion.

18. The support system of claim 17 wherein each lift includes at least one follower that is deployed immediately adjacent but not attached to said peripheral support structure for raising and lowering said peripheral support structure while allowing said peripheral support structure to rotate.

19. A drill pipe support system comprising:

a. a support frame having a central opening extending therethrough;

b. a wall inside said frame extending around said opening defining a hollow interior area;

c. a plurality of slips movably deployed in said hollow interior area;

d. a plurality of lever assemblies pivotally attached to said wall for extending and retracting said slips, each lever assembly comprising a first arm having a proximal end pivotally attached to at least one of said slips and a distal end pivotally attached to one end of a second arm, an opposite end of said second arm being operably attached to a peripheral support structure provided around the outside of said wall, said peripheral support structure being movable in an upward and downward direction relative to said wall;

e. at least one motion imparting member operably associated with said peripheral support structure, each such motion imparting member having at least one follower that is deployed immediately adjacent but not attached to said peripheral support structure for raising and lowering said peripheral support structure while allowing said peripheral support structure to rotate;

f. an annular gear member provided around said wall; and g. a second gear member attached to a rotation imparting member, the second gear member being engaged with said annular gear member for imparting rotational movement to said wall.

20. A drill pipe support system comprising:

a. a support frame having a central opening extending therethrough;

b. a wall inside said frame extending around said opening defining a hollow interior area;

c. a plurality of slips movably deployed in said hollow interior area;

d. a plurality of lever means for extending and retracting said slips, each lever means including an arm extending through a slot in said wall, each such arm having a central section pivotally engaged with said wall, each lever means being in communication with at least one of said slips and with a structure extending around the perimeter of said wall; and e. at least one means for imparting motion to said structure.

21. A drill pipe support unit for use with a mouse hole comprising:

a. a generally cylindrical support wall defining a hollow interior;

b. a plurality of slips movably deployed within said hollow interior; and c. a plurality of linkages, each linkage extending through a slot in said wall and having a central section pivotally engaged with said wall, one end of each linkage being pivotally attached to at least one of said moveable slips, and an opposite end of each linkage being in communication with a movable member capable of generally vertical movement;

wherein generally vertical movement of said movable member in one direction causes each linkage to force said at least one moveable slip attached thereto to move toward a central axis of said hollow interior, and wherein generally vertical movement of said movable member in the opposite direction causes each linkage to retract said at least one moveable slip attached thereto away from said axis.

22. The apparatus of claim 21 wherein said movable member further comprises an annular support structure encircling said generally cylindrical support wall.

23. The apparatus of claim 22 further comprising at least one lifting device for raising and lowering said annular support structure.

24. The apparatus of claim 23 wherein each of said at least one lifting devices further comprises at least one follower that is positioned immediately adjacent to but not attached to said annular support structure.

25. The apparatus of claim 24 wherein each follower further comprises at least one first guide member deployed below said annular support structure.

26. The apparatus of claim 25 wherein each follower further comprises at least one second guide member deployed above said annular support structure.

27. The apparatus of claim 24 wherein each follower further comprises at least one first rotatable member deployed above said annular support structure, and at least one second rotatable member deployed below said annular support structure.

28. The apparatus of claim 21 further comprising a separate movable member in communication with each linkage wherein each said separate movable member further comprises a lift for raising and lowering each linkage.

29. A drill pipe support unit for use with a mouse hole comprising:

a. a generally cylindrical support wall defining a hollow interior;

b. a plurality of slips movably deployed within said hollow interior;

c. a plurality of linkages, one end of each linkage being pivotally attached to at least one of said moveable slips, each linkage further comprising at least two arms wherein the first of said arms is pivotally attached adjacent to said generally cylindrical support wall forming a lever between said movable member and said at least one moveable slip, the second of said arms being pivotally attached at one end to an opposite end of said first arm, an opposite end of said second arm being in communication with a fixed location on a movable member capable of generally vertical movement;

wherein generally vertical movement of said movable member in one direction causes each linkage to force said at least one moveable slip attached thereto to move toward a central axis of said hollow interior, and wherein generally vertical movement of said movable member in the opposite direction causes each linkage to retract said at least one moveable slip attached thereto away from said axis.

30. The support unit of claim 29 further comprising a first gear member operably attached to said generally cylindrical support wall, and a second gear member engaged with said first gear member, said second gear member being attached to a rotatable motion imparting member for imparting rotational movement through said gears to said generally cylindrical support wall.

31. A drill pipe support system comprising:

a. a support frame having a central opening extending therethrough;

b. a wall inside said frame extending around said opening defining a hollow interior area;

c. a plurality of slips movably deployed in said hollow interior area; and d. a plurality of lever assemblies pivotally attached to said wall for extending and retracting said slips, each lever assembly having an arm with a proximal end operably attached to at least one of said slips and a distal end operably associated with at least one structure, said structure being capable of providing upward and downward movement to the distal ends of said arms, wherein said at least one structure is a single peripheral support structure provided around the outside of said wall, said structure being movable in an upward and downward direction relative to said wall, and said structure being operably associated with at least one motion imparting member provided in the form of a lift for raising and lowering said peripheral support structure; and wherein each lift includes at least one follower that is deployed immediately adjacent but not attached to said peripheral support structure for raising and lowering said peripheral support structure while allowing said peripheral support structure to rotate.

32. The support system of claim 31 wherein each follower is provided with at least one rotatable member deployed above said peripheral support structure, and at least one rotatable member deployed below said peripheral support structure.

33. In combination, an earthen hole and a drill pipe support system comprising:

a. a generally vertically oriented hole in the earth having a width large enough to receive a vertically oriented section of drill pipe, and a depth that is sufficient to receive at least two attached drill pipe sections;

b. a support frame having a central opening extending therethrough axially positioned above said hole;

c. a wall inside said frame extending around said opening defining a hollow interior area;

d. a plurality of slips movably deployed in said hollow interior area; and e. a plurality of lever assemblies pivotally attached to said wall for extending and retracting said slips, each lever assembly having an arm with a proximal end operably attached to at least one of said slips and a distal end operably associated with at least one structure, said structure being capable of providing upward and downward movement to the distal ends of said arms, wherein said at least one motion imparting member is provided in the form of at least one lift for raising and lowering said peripheral support structure in a uniform fashion, each lift including at least one follower that is deployed immediately adjacent but not attached to said peripheral support structure for raising and lowering said peripheral support structure while allowing said peripheral support structure to rotate.

34. A drill pipe support unit for use with a mouse hole comprising:

a. a generally cylindrical support wall defining a hollow interior;

b. a plurality of slips movably deployed within said hollow interior; and c. a plurality of linkages, one end of each linkage being pivotally attached to at least one of said moveable slips, and an opposite end of each linkage being in communication with a movable member capable of generally vertical movement;

wherein generally vertical movement of said movable member in one direction causes each linkage to force said at least one moveable slip attached thereto to move toward a central axis of said hollow interior, and wherein generally vertical movement of said movable member in the opposite direction causes each linkage to retract said at least one moveable slip attached thereto away from said axis; wherein said movable member further comprises an annular support structure encircling said generally cylindrical support wall, wherein at least one lifting device is provided for raising and lowering said annular support structure; and wherein each of said at least one lifting devices further comprises at least one follower that is positioned immediately adjacent to but not attached to said annular support structure.

35. The apparatus of claim 34 wherein each follower further comprises at least one first guide member deployed below said annular support structure.

36. The apparatus of claim 35 wherein each follower further comprises at least one second guide member deployed above said annular support structure.

37. The apparatus of claim 34 wherein each follower further comprises at least one first rotatable member deployed above said annular support structure, and at least one second rotatable member deployed below said annular support structure.

38. A drill pipe support system comprising:

a. a support frame having a central opening extending therethrough;

b. a wall inside said frame extending around said opening defining a hollow interior area;

c. a plurality of slips movably deployed in said hollow interior area; and d. a plurality of lever assemblies for extending and retracting said slips, each lever assembly comprising an arm extending through a slot in said wall, each arm having (i) a proximal end operably attached to a plurality of said slips, (ii) a central section pivotally engaged with said wall, and (iii) a distal end operably associated with at least one structure, said structure being capable of providing movement to the distal ends of said arms.

* * * * *